US006434794B1

(12) United States Patent
Foster et al.

(10) Patent No.: US 6,434,794 B1
(45) Date of Patent: Aug. 20, 2002

(54) METHOD AND APPARATUS FOR BLENDING TEXTILE FIBERS

(75) Inventors: Raymond Keith Foster, 1029 MW birch La. P.O. Box 1, Madras, OR (US) 97741; Mark Jay Beason, Redmond, OR (US)

(73) Assignee: Raymond Keith Foster, Madras, OR (US)

( * ) Notice: Subject to any disclaimer, the term of this patent is extended or adjusted under 35 U.S.C. 154(b) by 0 days.

(21) Appl. No.: 09/782,571

(22) Filed: Feb. 13, 2001

Related U.S. Application Data

(63) Continuation-in-part of application No. 09/654,144, filed on Sep. 1, 2000.

(51) Int. Cl.[7] ..... D01B 1/00
(52) U.S. Cl. ..... 19/80 R; 19/145.5
(58) Field of Search ..... 19/65 R, 85, 87, 19/90, 91, 93, 94, 80 R, 97, 97.5, 144, 145.5

(56) References Cited

U.S. PATENT DOCUMENTS 4,117,571 A * 10/1978 Prather ..... 19/80 R
4,190,933 A * 3/1980 Jagst ..... 19/145.5
4,244,082 A * 1/1981 Leifeld et al. ..... 19/145.5
4,313,242 A * 2/1982 Salmon ..... 19/55 R
4,479,285 A * 10/1984 Ragan ..... 19/80 R
4,497,085 A * 2/1985 Van Doorn et al. ..... 19/80 R
4,548,131 A * 10/1985 Williams ..... 19/80 R
4,766,648 A * 8/1988 Kerley ..... 19/80 R
4,908,910 A * 3/1990 Pinto et al. ..... 19/145.5
5,025,533 A * 6/1991 Faas et al. ..... 19/145.5
5,121,841 A * 6/1992 Harrington et al. ..... 19/80 R
5,222,675 A * 6/1993 Stover ..... 241/101.1
5,315,738 A * 5/1994 Pinto et al. ..... 19/145.5
5,340,264 A * 8/1994 Quaeck ..... 414/525.9
5,469,603 A * 11/1995 Stover ..... 19/80 R
5,537,809 A * 7/1996 Blalock ..... 19/80 R
5,934,445 A * 8/1999 Foster et al. ..... 198/750.5

* cited by examiner

*Primary Examiner*—Danny Worrell
*Assistant Examiner*—Gary L. Welch
(74) *Attorney, Agent, or Firm*—Delbert J. Barnard

(57) ABSTRACT

Two dispersers tunnels (20, 22) are provided at a disperser station. Each disperser tunnel (20, 22) houses two dispersers (24, 26 and 28, 30). Each pair of dispersers (24, 26 and 38, 30) are spaced apart and confront each other, with a mixing zone (42, 54) being defined between them. A separate conveyor (32, 34, 36, 38) is provided for feeding textile fiber modules, e.g. cotton boll modules (18, 18', 18", 18'"), to the dispersers (24, 26, 28, 30). Each pair of dispersers (24, 26) removes fiber clumps from the leading ends of the modules (18, 18', 18", 18'") and dispenses them into the mixing zone (42, 54) in admixture with the fiber clumps from the other disperser (24, 26, 28, 30) of the pair. The blend or mixture of fiber clumps is collected in the upper run (50) of a conveyor (52) that serves to carry the fiber clumps away from the disperser station. The feed rate of the modules (18, 18', 18", 18'") may be regulated and varied by regulating and varying the speed rates of the conveyors (32, 34, 36, 38).

30 Claims, 18 Drawing Sheets

FIG.12
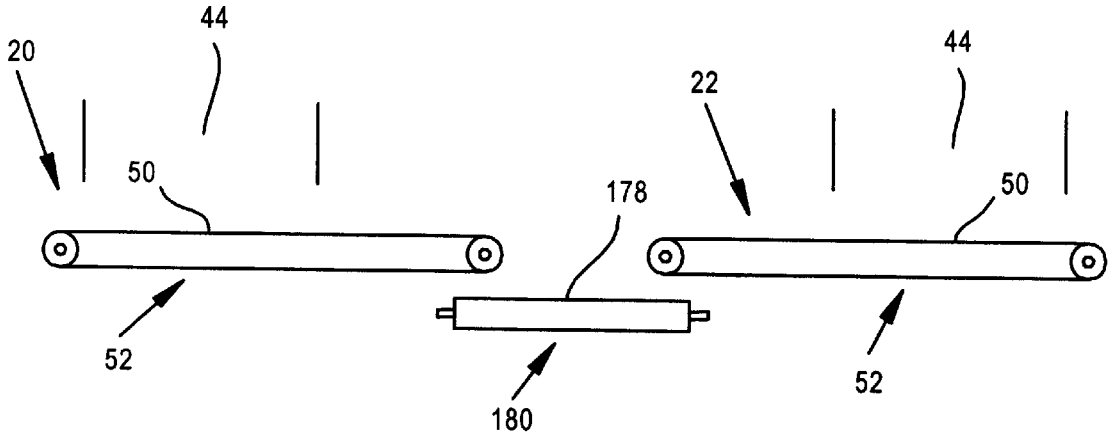
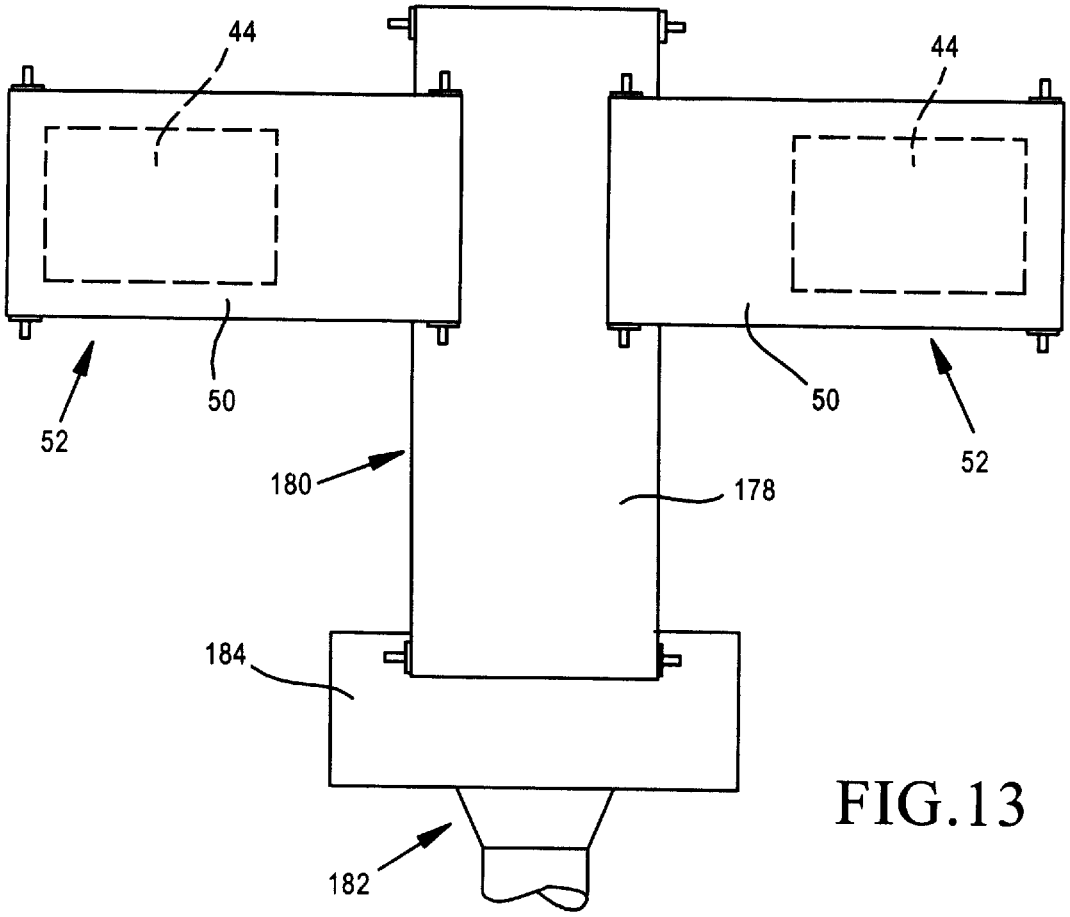
FIG.13

FIG.14
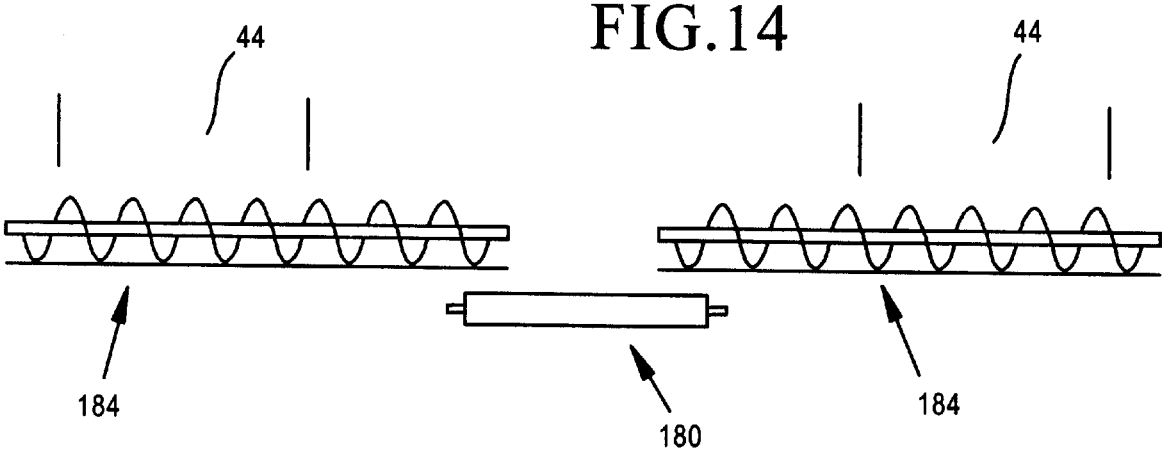
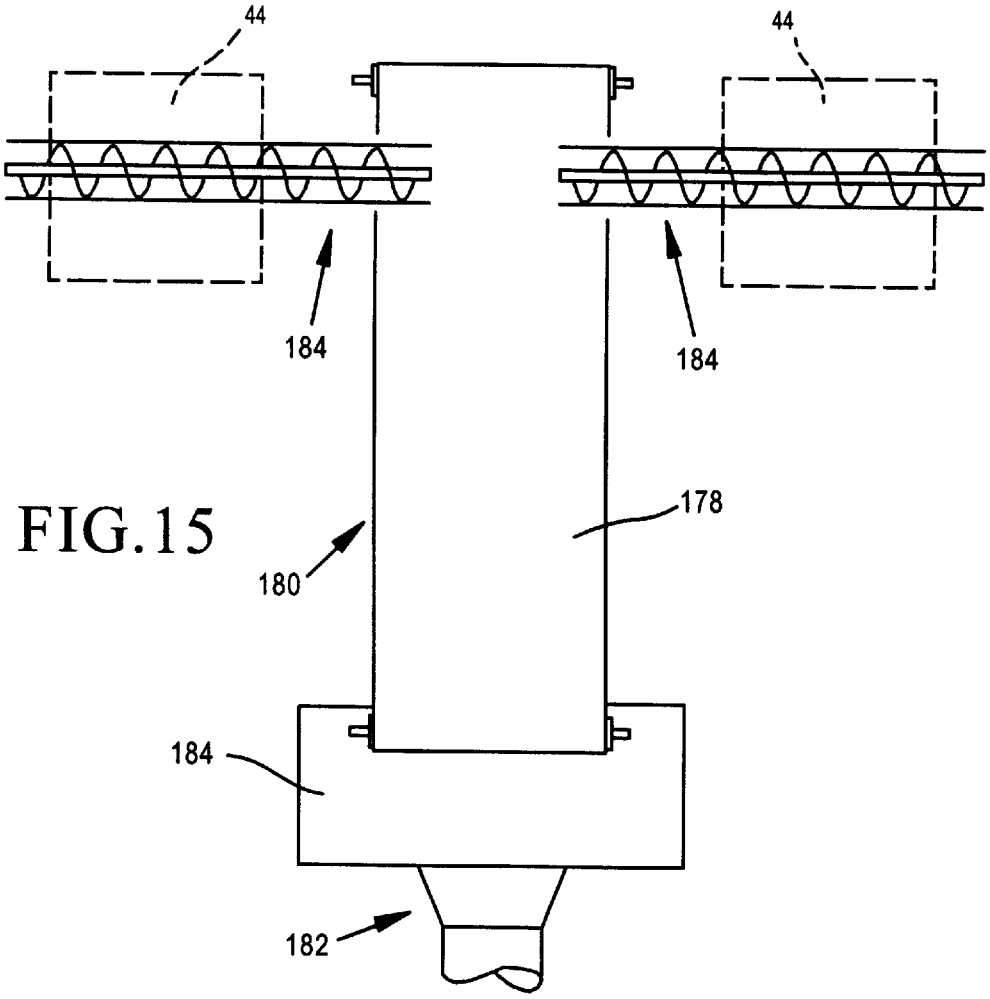
FIG.15

FIG.16
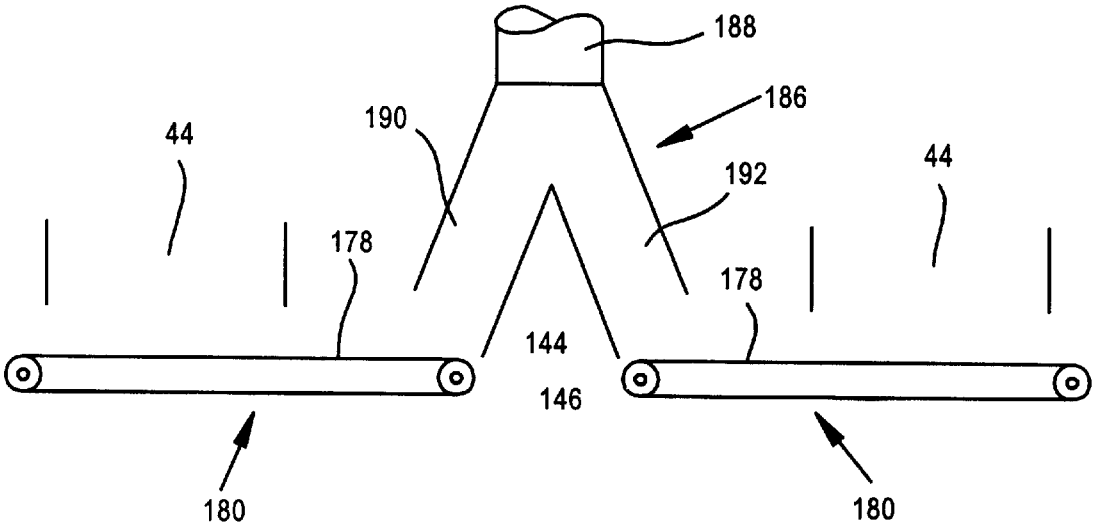
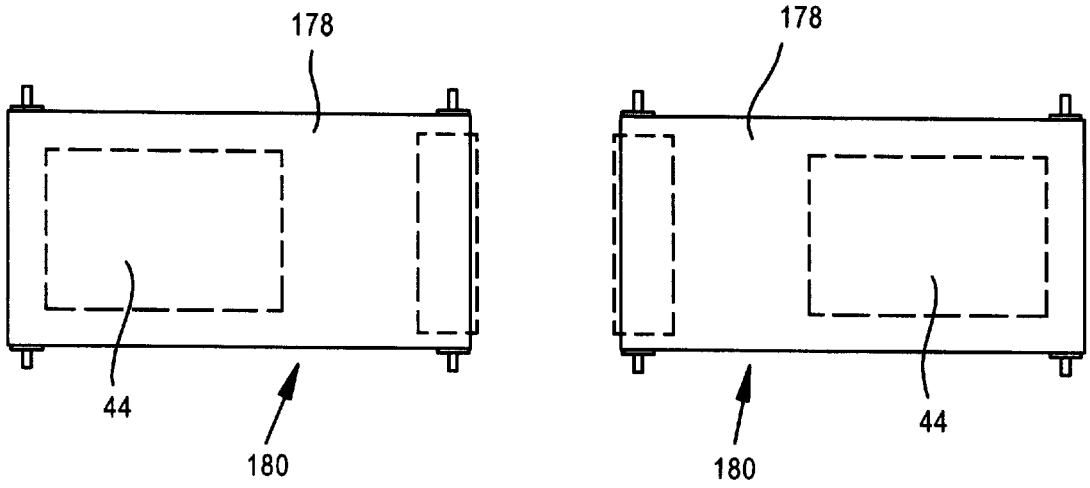
FIG.17

METHOD AND APPARATUS FOR BLENDING TEXTILE FIBERS

RELATED APPLICATION

This application is a continuation-in-part of our application Ser. No. 09/654,144, filed Sep. 1, 2000, and entitled Method and Apparatus For Mixing Textile Fibers and Particulate Material.

TECHNICAL FIELD

This invention relates to a method and apparatus for dispersing fiber clumps, e.g. cotton boll clumps, from two or more textile fiber modules, e.g. cotton boll modules, at the same time, and mixing the clumps to form a blend and then cleaning and ginning the clumps to form a cotton lint blend.

BACKGROUND OF THE INVENTION

Below there is a description of the handling of cotton fibers, starting with the harvesting of cotton bolls. However, the invention is not limited to the handling of cotton fibers but rather applies equally as well to the handling of other textile fibers that have been compressed into large modules that need to be mechanically dispersed into clumps of fibers so that the fibers can be separated, cleaned and then further processed, ultimately into yarns.

As known to those skilled in the art, cotton plants produce seedpods, known as cotton bolls, which contain the seeds. Seed hairs, or fibers, growing from the outer skin of the seeds, become tightly packed within the boll, which bursts open upon maturity, revealing soft masses of the fibers. These fibers are white to yellowish white in color, range from about 0.75 to about 1.5 inches in length and are composed of about 85–90% cellulose, a carbohydrate plant substance; five to eight percent water; and four to six percent natural impurities.

Cotton is harvested when the bolls open. In the fields, the cotton bolls are tightly compressed into large modules which are transported from the fields to processing plants. In the processing plants, the modules are mechanically dispersed into clumps of bolls and then the fibers are separated from the seeds and are cleaned and then are further processed, ultimately into yarns.

It is known to disperse the cotton boll modules by use of a stack of rolls that include fingers which rotate into an advancing end of a cotton module, to tear loose clumps of the bolls from the module as they rotate. The stack of rolls is termed a disperser and it is common to use conveyors for delivering the cotton modules to the disperser. Example disperser systems are disclosed by the following U.S. Pat. No. 4,497,085, granted Feb. 5, 1985 to Donald W. Van Doorn, James B. Hawkins, Tommy W. Webb and William A. Harmon, Jr.; U.S. Pat. No. 5,121,841, granted Jun. 16, 1992, to Keith Harrington and Donald Rogers; U.S. Pat. No. 5,222,675, granted Jun. 29, 1993, to Jimmy R. Stover; U.S. Pat. No. 5,340,264, granted Aug. 23, 1994, to Manfred W. Quaeck and U.S. Pat. No. 5,469,603, granted Nov. 28, 1995, to Jimmy R. Stover. These patents show examples of the conveyors which have been used, or proposed, for delivering the cotton modules to the disperser. The present invention is not limited to any particular type of conveyor. However, a reciprocating slat conveyor is preferred. Example reciprocating slat conveyors that are suitable are disclosed by U.S. Pat. No. 5,934,445, granted Aug. 10, 1999, to Raymond Keith Foster, Randall M. Foster and Kenneth A. Stout, and U.S. Pat. No. RE 35,022, granted Aug. 22, 1995, to Raymond Keith Foster.

Cotton fibers, for example, may be roughly classified into three main groups, based on staple length (average length of the fibers in a cotton module) and appearance. The first group includes the fine, lustrous fibers with staple length ranging from about 1 to about 2.5 inches and includes types of the highest quality—such as Sea Island, Egyptian and Pima cottons. Least plentiful and most difficult to grow, long-staple cottons are costly and are used mainly for fine fabrics, yarns and hosiery. The second group contains the second group contains the standard medium-staple cotton, such as American Upland, with staple length from about 0.5 to 1.3 inches. The third group includes the short-staple, coarse cottons, ranging from about 0.375 to 1 inch in length, used to make carpets and blankets, and to make coarse and inexpensive fabrics when blended with other fibers. Within each group, the quality of the fibers can vary depending on such things as where the cotton is grown. It is desirable to blend the lower quality fibers with higher quality fibers to produce an acceptable quality blend of fibers. It is an object of the present invention to provide a method and apparatus for blending cotton clumps as they are removed from the cotton modules. The clumps of bolls are mixed together to form the blend and then the blend is further processed to separate the fibers from the seeds, etc.

Another object of the present invention is to provide a method and apparatus for blending other types of textile fiber clumps as they are removed from the textile fiber modules. Clumps from different modules are mixed together to form a blend of the fibers and then the blend is conveyed on for further processing.

It is yet another object of the invention to provide a method and apparatus for mixing particulate materials, such as different types and/or grades of wood fiber chips, and wood fiber chips with other materials, e.g. granule recycled plastic.

BRIEF SUMMARY OF THE INVENTION

One apparatus of the present invention is basically characterized by a pair of confronting dispersers, each having an input side and an output side. The output sides of the two dispersers face each other on opposite sides of a mixing zone. An infeed conveyor is provided for each disperser. Each infeed conveyor is adapted to feed textile fiber modules into the input side of its disperser. An outfeed conveyor is positioned between the two dispersers, at the bottom of the mixing zone. The infeed conveyors are adapted to move the modules in to the dispersers. Each disperser removes fiber clumps from its module and discharges them into the mixing zone into admixture with fiber clumps from the other disperser. The mixed blend of fiber clumps falls on the outfeed conveyor and the output conveyor carries the blend away from the mixing zone.

Each disperser comprises a plurality of power driven rolls, each of which is supported for rotation about a horizontal axis and includes a plurality of fingers that move into and then out from the module as the rollers rotate. The fingers are adapted to remove fiber clumps from the module and project them into the mixing zone.

Preferably, the outfeed conveyor extends generally perpendicular to the infeed conveyors. Preferably also, the infeed conveyors are reciprocating slat conveyors. The outfeed conveyor may be an endless belt conveyor or a helical screw conveyor.

According to an aspect of the invention, the apparatus may comprise first and second pairs of confronting dispersers of the type described, each disperser having its own infeed conveyor. The outfeed conveyor may pick up a blend of fiber clumps from the first mixing zone and move the blend onto the second mixing zone where a second blend of fibers and fiber clumps is deposited onto the fiber clumps already on the outfeed conveyor. Or, each pair of dispersers may include its own outfeed conveyor and the two outfeed conveyors may carry the fiber clamps onto a blend conveyor.

The method of the present invention is basically characterized by positioning first and second dispersers at a disperser station, in a spaced apart confronting relationship, so as to define a mixing zone between them. The first and second dispersers are operated while a first module is fed into the first disperser and a second module is fed into the second disperser. The first and second dispersers are operated so that each will disperse fiber clumps from its module and deliver them into the mixing zone in admixture with fiber clumps from the other disperser. The mixture of fiber clumps is collected at the bottom of the mixing zone and is carried away from the disperser station.

Another aspect of the invention is to feed the modules against the dispersers by use of conveyors and controlling the feed rate by controlling the conveyor speed.

A further aspect of the invention is to provide third and fourth dispersers at the disperser station, also in a spaced apart confronting relationship, so as to define a second mixing zone between them. The third and fourth dispersers are operated while a third textile fiber module is fed into the third disperser and a fourth textile fiber module is fed into the fourth disperser. The third and fourth dispersers are operated so that each will disperse fiber clumps from its module and deliver them into the second mixing zone in admixture with the fiber clumps from the other disperser of the pair. The mixture of fiber clumps is collected at the bottom of the second mixing zone, on top of the mixture of fiber clumps from the first mixing zone, and the total mixture is carried away from the disperser station. Or, each pair of dispersers may have its own outfeed conveyor and the two outfeed conveyors may deliver their fiber clumps to a blend conveyor.

An object of the present invention is to provide a cotton handling system that includes infeed conveyors for delivering textile fiber modules to dispersers and outfeed conveyors for moving textile fiber clumps away from the dispersers. The infeed conveyors may be reciprocating slat conveyors. The outfeed conveyors may be mechanical conveyors, including endless belt conveyors and helical screw conveyors. They can be a system of conveyors which includes a mechanical conveyor section followed by an airstream conveyor section.

It is within the scope of the invention for the outfeed conveyors to be either below or above the level of the infeed conveyors or module pads on the input sides of the dispersers.

An important object of the present invention is that textile fiber clumps form a plurality of modules are mixed together to form a textile fiber blend at the dispersers and/or between the dispersers and the cleaners that receive the textile fiber clumps from the dispersers. Mixing or blending occurs in airstream conveyors which move the textile fiber clumps from the disperser station onto the. dryers, cleaners and gins. This mixing or blending of the textile fiber clumps results in the subsequent operations handling the mixture or blend. In these operations there is additional mixing and blending of the textile fiber clumps. Additional mixing or blending also occurs in the gins as the textile fiber clumps are being processed by the gins.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL OF THE DRAWING

Like reference numerals and letters refer to like parts throughout the several views of the drawing, and:

FIG. 12 is a side elevational diagram showing two outfeed conveyors positioned to discharge onto the third conveyor;

FIG. 13 is a top plan view of the conveyor assembly of FIG. 12, showing the third conveyor discharging in to the inlet of a fluid conveyor;

FIG. 14 is a view like FIG. 12, but showing the use of helical screw-type outfeed conveyors;

FIG. 15 is a view like FIG. 13, but showing helical screw-type outfeed conveyors;

FIG. 16 is a view like FIGS. 12 and 14, but showing the two feed conveyors positioned to convey cotton clumps to an inlet for an air conveyor;

FIG. 17 is a view like FIGS. 13 and 15, but of the conveyor assembly shown by FIG. 16;

DETAILED DESCRIPTION OF THE INVENTION

Figures 1, 2:
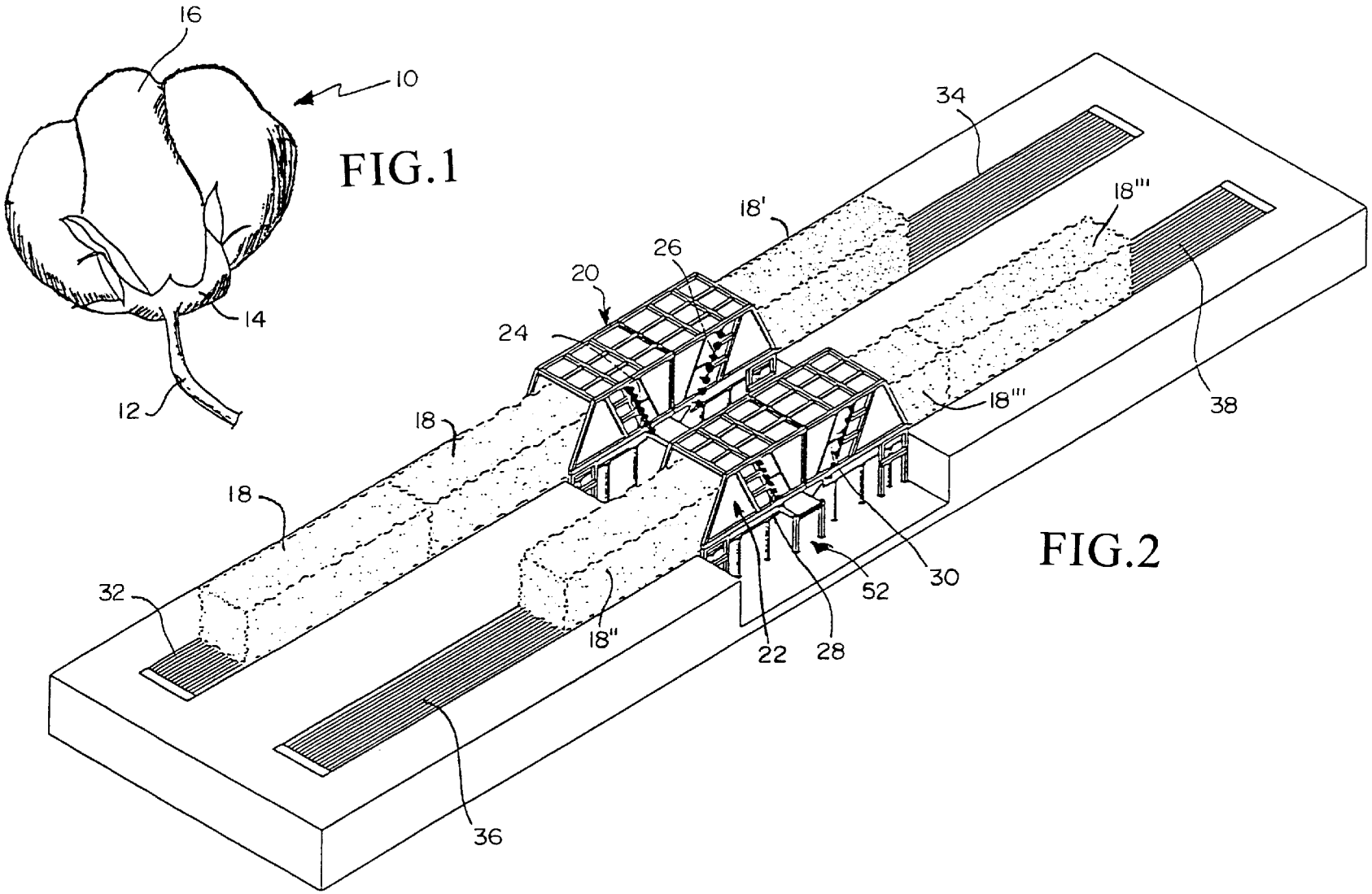
FIG. 1 is a pictorial view of a mature cotton boll, showing how it appears when harvested.
FIG. 2 is a pictorial view of a first example apparatus that incorporates aspects of the present invention which is adapted for dispersing clumps of cotton bolls from a plurality of cotton modules and mixing them together for delivery to the next stage of processing, such view being taken from above and looking towards the top, one side and one end of the apparatus.

FIG. 1 is a pictorial view of a single cotton boll substantially as it appears at harvest time. The boll 10 comprises a stem 12, a base 14 connected to the stem 12 and a ball of seed hairs, or fibers, growing from the outer skin of seeds that are within the boll 10. In a manner that is well known in the art, the cotton bolls 10 are removed from the cotton plant and are tightly compressed into large modules 18, 18', 18", 18'" that are removed from the field and transported to the processing plant.

FIG. 2 shows a disperser station at a processing plant that 15 incorporates the present invention. This disperser station comprises a pair of disperser tunnels 20, 22 each including a pair of confronting dispersers 24, 26 and 28, 30. Each disperser, 24, 26, 28, 30 is provided with its own infeed conveyor 32, 34, 36, 38. In the illustrated system, the infeed conveyors 32, 34, 36, 38 are reciprocating slat conveyors.

Figure 3:
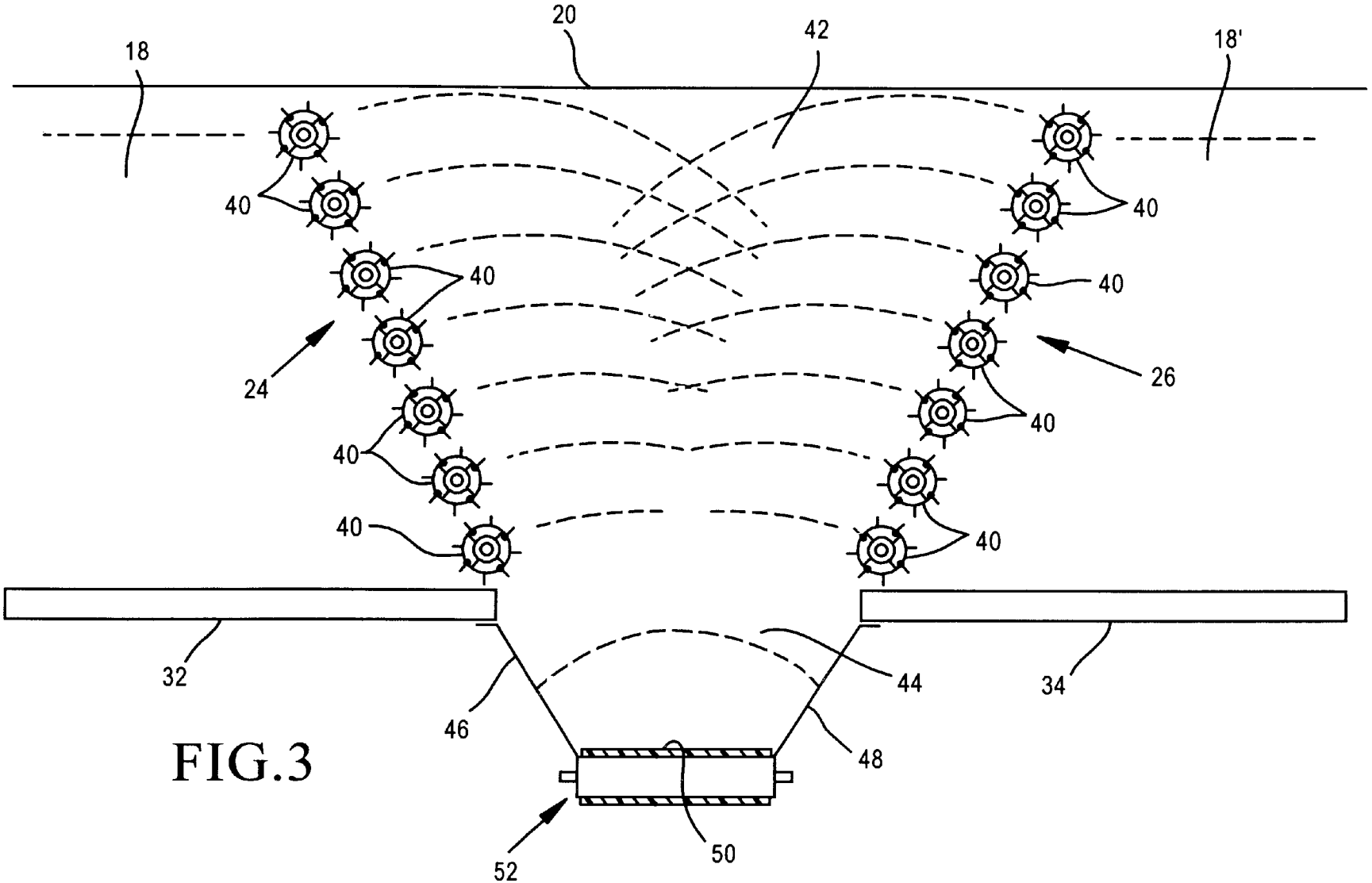
FIG. 3 is a diagrammatic sectional view through the center region of the apparatus shown by FIG. 2, showing a mixing zone formed by and between two dispersers, and an output conveyor below the mixing zone.

FIG. 3 is a longitudinal sectional view of disperser tunnel 20 and its two dispersers 24, 26. In FIG. 3, the structure is somewhat schematically shown as the constructional details of the tunnel 20 is not particularly important to the present invention. FIG. 3 shows infeed conveyor 32 positioned and arranged to feed the modules 18, 18', 18", 18'" into the input sides of the dispersers 24, 26, respectively. In this embodiment, the dispersers 24, 26 are identical and each comprises a plurality of disperser rolls 40. In each disperser 24, 26, the bank of rolls 40 lean to the rear from vertical. A lean angle x (FIG. 9) of about thirty degrees (30°) is illustrated. A mixing zone 42 in the shape of an inverted trapezoid is defined by and between the two dispersers 24, 26 and below the top of the disperser tunnel 20. Mixing zone 42 includes a lower portion 44 situated below the conveyors 32, 34 and above the upper run 50 of an outfeed conveyor 52. Mixing zone portion 44 includes sidewalls 46, 48 that slope downwardly from the conveyors 32, 34 to the upper run 50 of the conveyor 52.

Figure 4:
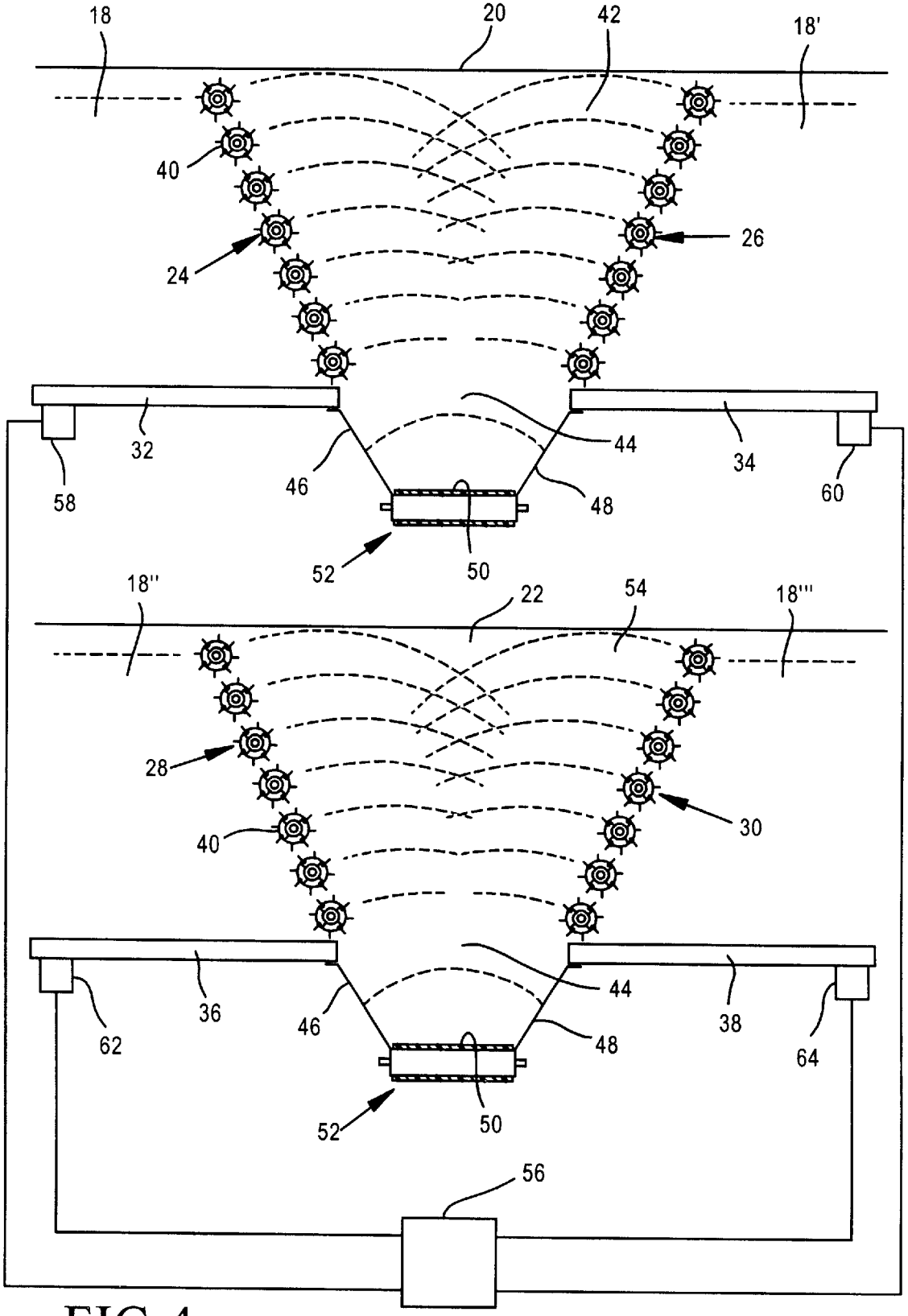
FIG. 4 is a view similar to FIG. 3, but showing two pairs of dispersers, a mixing zone between the dispersers of each pair, and including a schematic diagram of a computer controlled system for controlling the speed rate of the conveyors that deliver the cotton modules to the dispersers.
Figure 5:
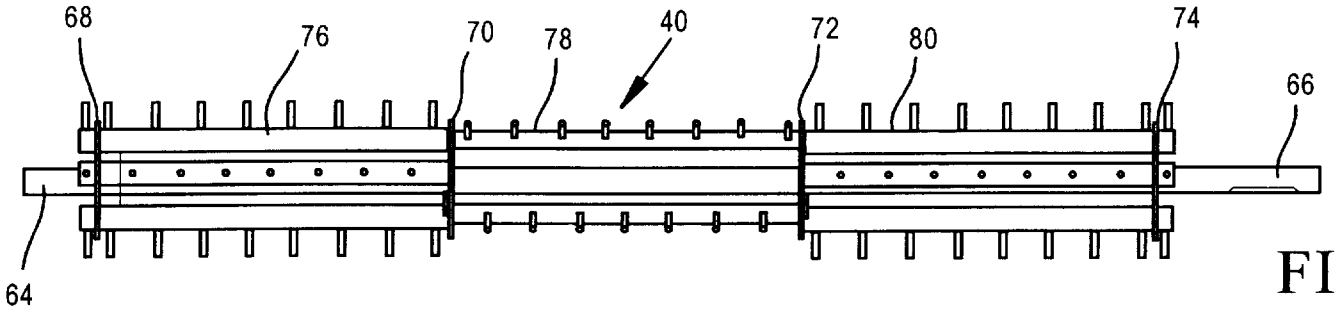
FIG. 5 is a side elevational view of one of the disperser rollers.

FIG. 4 shows a schematic of the disperser tunnel 22 below the schematic of the disperser tunnel 20. In FIG. 4, a mixing zone 54 is shown between the two dispersers 28, 30 and below the top of the mixing tunnel 22. Mixing zone 54 is in series with mixing zone 42 and it shares the same outfeed conveyor 52 and the same sidewalls 46, 48.

At times, it may be desirable to use a single disperser (e.g. disperser 24) in a single disperser tunnel (e.g. tunnel 20), in which case the associated conveyor (e.g. conveyor 32) will be operated to move modules 18 into the dispersing tunnel and against the rolls 40 of the disperser 24.

Figure 9:
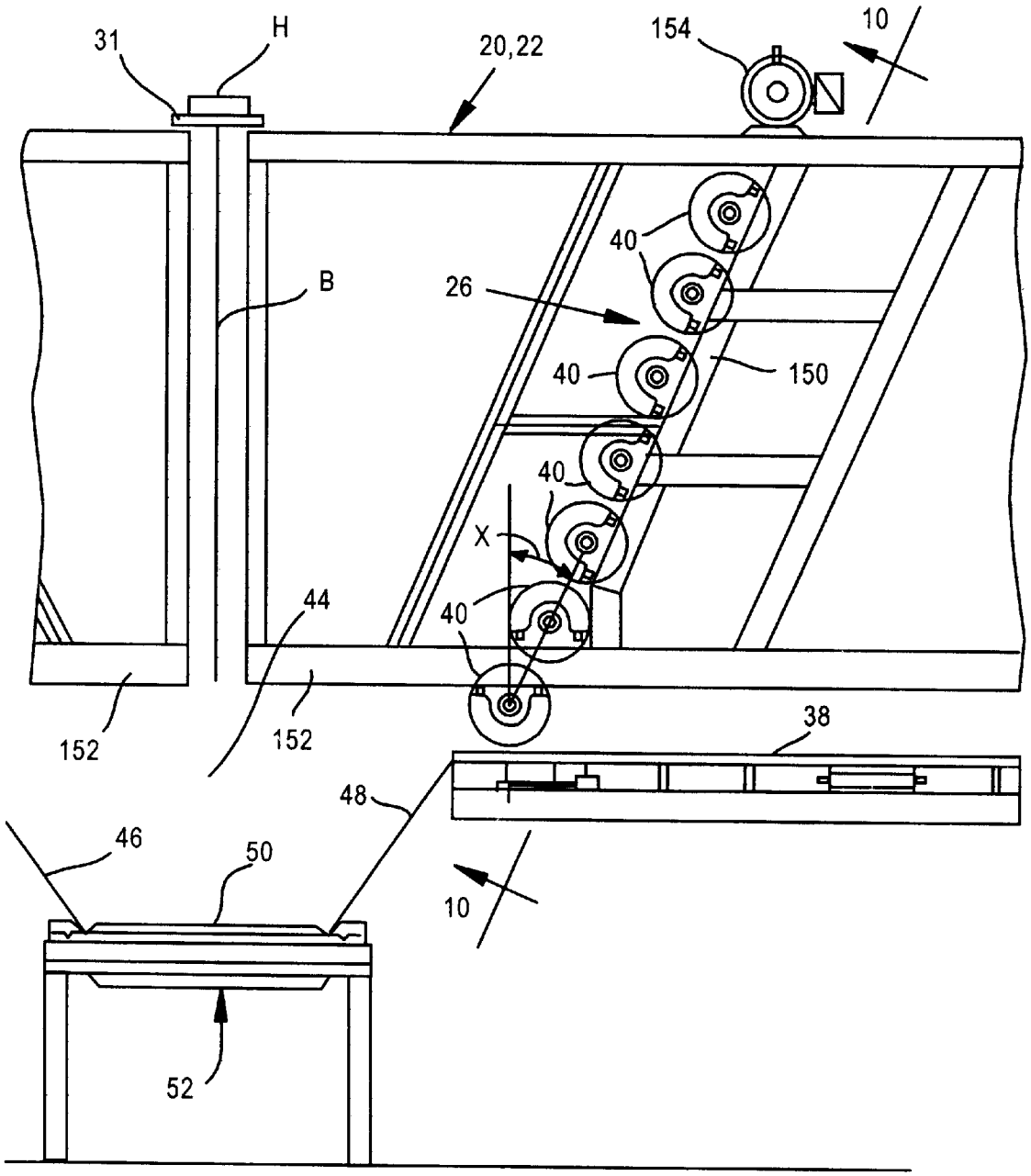
FIG. 9 is a fragmentary view looking towards one side of one of the disperser tunnels, such view showing the two end halves of the disperser tunnel moved apart and a baffle positioned in the center of the mixing zone, between the two dispersers, such view also showing how the disperser rolls and drive motor are mounted on the frame of the disperser tunnel.
Figure 11:
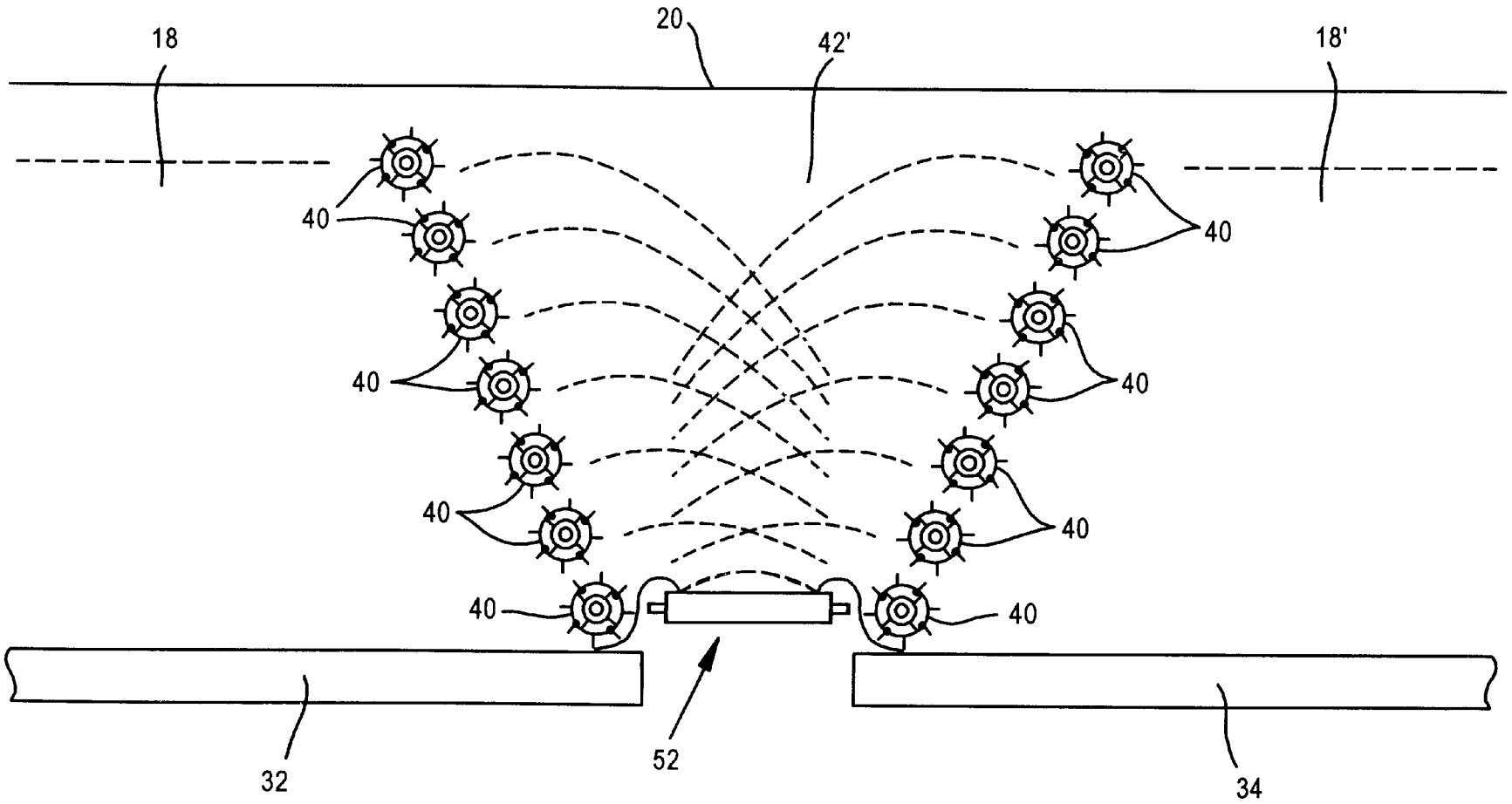
FIG. 11 is a view like FIG. 3, but showing the outfeed conveyor above the floor level.

Preferably, when a single disperser is used, a baffle B is positioned at the center of the disperser tunnel 20. As shown by FIGS. 2, 9 and 11, each disperser tunnel 20, 22 may be constructed in two longitudinal halves. In FIG. 9, the two halves are shown spaced apart. This is so that a baffle B can be included in the view. Preferably, the two tunnel parts are connected together and a slot is provided in the top of the assembly where the two parts meet. The slot leads into vertical slideways that are positioned to collect opposite side edge portions of the baffle B. A top plate 31 may extend along the upper edge of the baffle B. One or more handles H may be secured to the plate 31. In use, when it is desired to use only a single disperser, e.g. disperser 24, in a single disperser tunnel, e.g. tunnel 20, a workman need only pick up the baffle B by use of the handle or handles H. The lower edge of the baffle B can be dropped into the slot provided at the top of the tunnel. Then, the baffle B may be allowed to move downwardly under the influence of gravity until the top plate 31 is on top of the disperser tunnel, overlying the top and the slot and portions of the tunnel top that immediately border the slot. Whenever it is desired to use both dispersers at once, the workman need only grab the handle or handles H and pull the baffle B up out of the slideways and set it to one side. Of course, other ways may be used for providing a baffle B at the center of the mixing zone.

When the baffle B is in place, the fiber clumps that are being thrown into the mixing zone by the disperser that is operating will strike the baffle B and then drop downwardly onto the outfeed conveyor 52.

As will hereinafter be described in greater detail, rotation of the disperser rolls 40 will move fingers into the module 18 that will dislodge clumps of fibers from the front end of the module 18. As the fingers move into, then through, and then out from the module 18, they form the clumps and then throw the clumps into the chamber 42. The clumps then fall by gravity onto the upper run 50 of the outfeed conveyor 52. The output conveyor 52 then moves the clumps on to the next station in the processing plant. Herein, the term "cotton boll clumps" includes a single cotton boll, a portion of a single cotton boll, a plurality of cotton bolls, and one or more cotton bolls stuck together by themselves or with any portion or portions of one or more additional cotton bolls. The term "textile fiber clumps" means the same thing but also includes other textile fiber materials. Hereinafter, the apparatus and method will sometimes be described by referring to cotton bolls and cotton boll clumps by way of example.

Referring again to FIG. 3, at times it may be desired to remove cotton boll clumps from two modules 18, 18' at the same time, by operating both conveyors 32, 34 at the same time. Conveyor 32 is operated to move a module 18 into the input of disperser 24 while conveyor 34 is operated to move a module 18' into the input of disperser 26. When this is done, the cotton clumps from the two modules 18, 18' are mixed together in the mixing zone 42. In FIG. 3, broken lines are used to show the travel paths of the cotton boll clumps. Mixing occurs as the cotton boll clumps are propelled into the mixing zone 42 so it can be said that each disperser 24, 26 removes cotton boll clumps from its module 18, 18' and discharges them into the mixing zone 42 into admixture with the cotton boll clumps from the other dispenser 24, 26. When both conveyors 32, 34 and both dispersers 24, 26 are operated, a blend of cotton boll clumps is formed in the mixing zone 42. This blend drops onto the upper run 50 of the outfeed conveyor 52.

As will be appreciated, the two conveyors 32, 34 can be operated at either substantially the same feed rate or at different feed rates. When operating them at substantially the same feed rate, the blend will comprise approximately 50% cotton boll clumps from module 18 and 50% cotton boll clumps from module 18'. Or, the feed rate of the conveyors 32, 34 may be different. For example, conveyor 32 may be operated to cause travel twice as fast as conveyor 34. In this event, the blend or mixture will comprise two parts cotton boll clumps from module 18 and one part cotton boll clumps from module 18'.

Referring again to FIG. 4, it may be desirable to mix together cotton boll clumps from three grades or types of module. For example, conveyors 32, 34 and 36 may be operated at the same time, each at substantially the same feed rate or at different feed rates. In this mode of operation, a baffle B will be inserted between disperser 28, 30. The cotton boll clumps that are dispersed from disperser 28 strike the baffle B and then fall down and are deposited onto the blend of cotton boll clumps from dispersers 24, 28 that is on the upper run 50 of the conveyor 52.

The system also permits the mixing together of cotton boll clumps from four distinct modules. This is done by utilizing all four conveyors 32, 34, 36, 38 for simultaneously feeding four modules 18, 18', 18", 18'", each with a different quality content. Operation of conveyors 32, 34 and dispersers 24, 26 will admix cotton boll clumps from modules 18, 18'. They will drop down onto the upper run 50 of the conveyor 52. Operation of conveyors 36, 38 and dispersers 28, 30 together will admix cotton boll clumps from modules 18", 18'". This mixture will drop on the mixture of cotton boll clumps from modules 18, 18' which is already on the upper run 50 of the conveyor 52.

FIG. 4 shows a schematic diagram of a control system that includes a programmed computer 56 that is adapted to send control signals to feed control devices 58, 60, 62, 64 associated with the conveyors 32, 34, 36, 38. The control system disclosed in the aforementioned U.S. Pat. No. 5,934,445 includes a programmable processor or computer and circuit components for varying the feed rate of the conveyor. It is within the skill of the art for a programmer to adapt the processor 56 so that it can be used for controlling the feed rates of the four conveyors 32, 34, 36, 38. The processor 56 can be programmed to select how many of the conveyors 32, 34, 36, 38 will be used at a given time, and the feed rate of each conveyor. It can also be programmed to turn the dispersers 24, 26, 28, 30 on and off, and also control the speed rate of the rollers 40.

Keith Manufacturing Company of 401 N.W. Adler, Madras, Oreg. 97741, makes a conveyor known as the "Running Floor II®" unloading system or unloader. This system controls the feed rate of the conveyor by controlling the output of the pump that delivers hydraulic fluid to the hydraulic cylinders that move the conveyor slats. The pump output is controlled by controlling revolutions per minute of the tractor motor that drives the pump. In the system of FIG. 4, the conveyors 32, 34, 36, 38 can be Running Floor II® conveyors. The processor 56 can be programmed to vary the drive input to the pump or in another suitable way, vary the flow rate of hydraulic fluid to the hydraulic cylinders that move the conveyor slats.

Various ways may be used to determine the feed rate of fiber clumps into the mixing zones. For example, it can be calculated from knowing the cross sectional dimensions of the module and the conveyor speed. Also, sensors may be provided along the path of travel of each module and used to determine movement of a particular part of the module over a particular amount of time. Each module may be provided with a mark on its side or top and the sensors may be positioned to monitor the position of this mark. The information received from the sensors can then be fed to the control system, as a feedback system, and used for changing the speed rate of the conveyor.

FIGS. 5–8 show a preferred construction of the disperser roll 40, also termed the "spike roll". This construction is quite simple but yet provides a very sturdy, durable roller. In preferred form, roller 40 includes an elongated tubular core 60 that extends substantially the full length of the main body of the roll. Core 60 is mounted for rotation by a live shaft 62 having end portions 64, 66 that extend axially outwardly of the opposite ends of the core 60. The core tube 60 may be supported on the member or members that provide the live shafts 64, 66 in any suitable manner, such as by use of disks or spiders that project radially outwardly from the members 64, 66 to the core tube 60. Members 64, 66 may be opposite end portions of a continuous member that extends all the way through the core tube 60. Or, they may be shorter members that are connected to the opposite end portions of the tubular core member 60.

The roll is divided into a plurality of sections by radial disks. In the illustrated embodiment, four disks 68, 70, 72, 74 are used. They divide the roll 40 into three sections that may be of substantially the same length or their lengths may vary to some extent. The disks 68, 70, 72, 74 may have a circular outline and may include a circular center opening through which the core tube 60 extends. The disks 68, 70, 72, 74 may be welded to the core tube 60.

The live shaft end portions 64, 66 are mounted for rotation in bearings. Shaft end portion 66 is connected to a suitable drive device for rotating the shaft portion 66, and hence, the roll 40. Bearing support systems and drive systems for disperser rolls are known in the prior art and do not per se form a part of the present invention.

Figure 6:
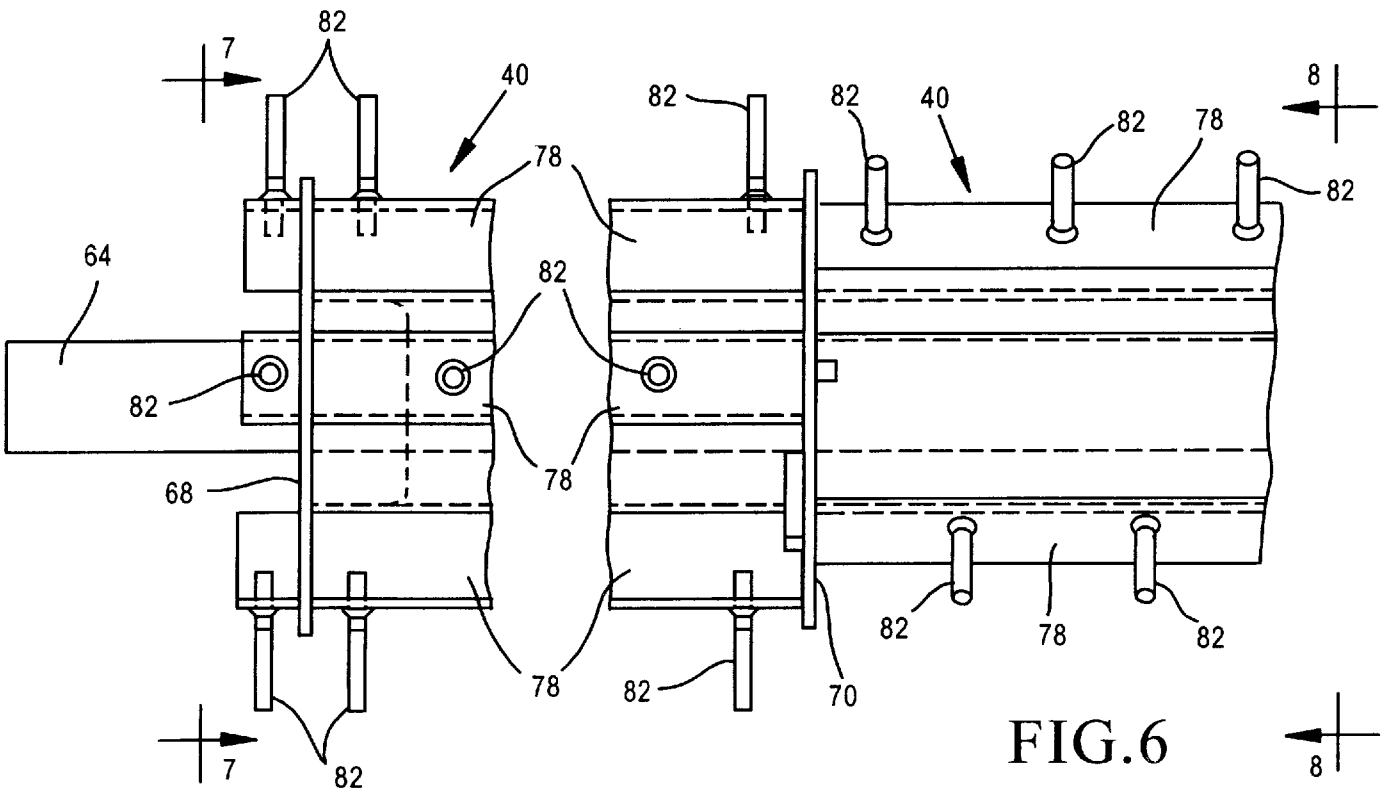
FIG. 6 is an enlarged scale fragmentary view of the roller shown by FIG. 5.
Figure 8:
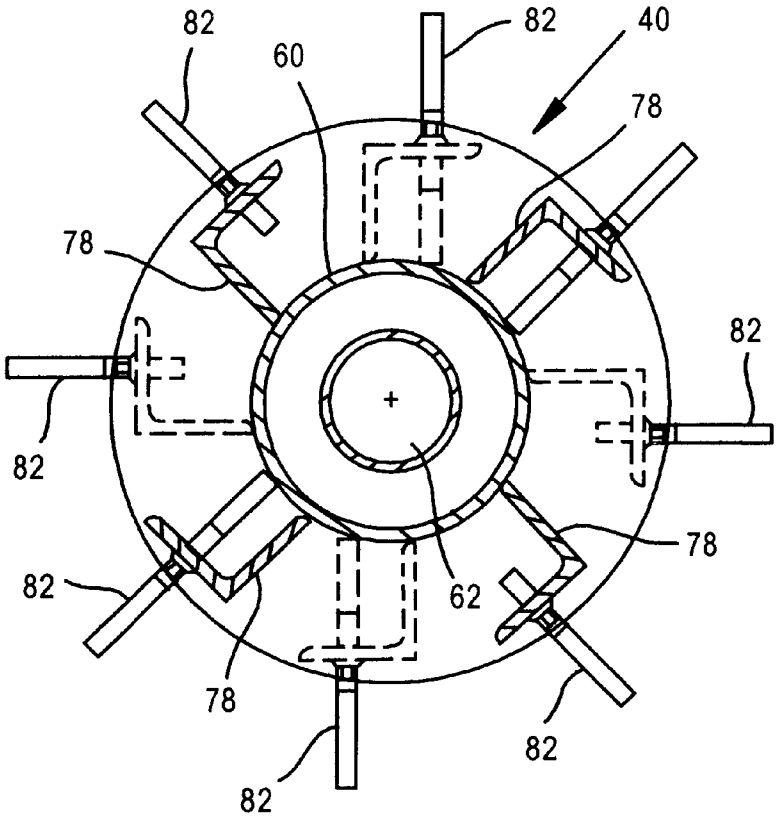
FIG. 8 is a sectional view taken substantially along line 8—8 of FIG. 6.
Figure 7:
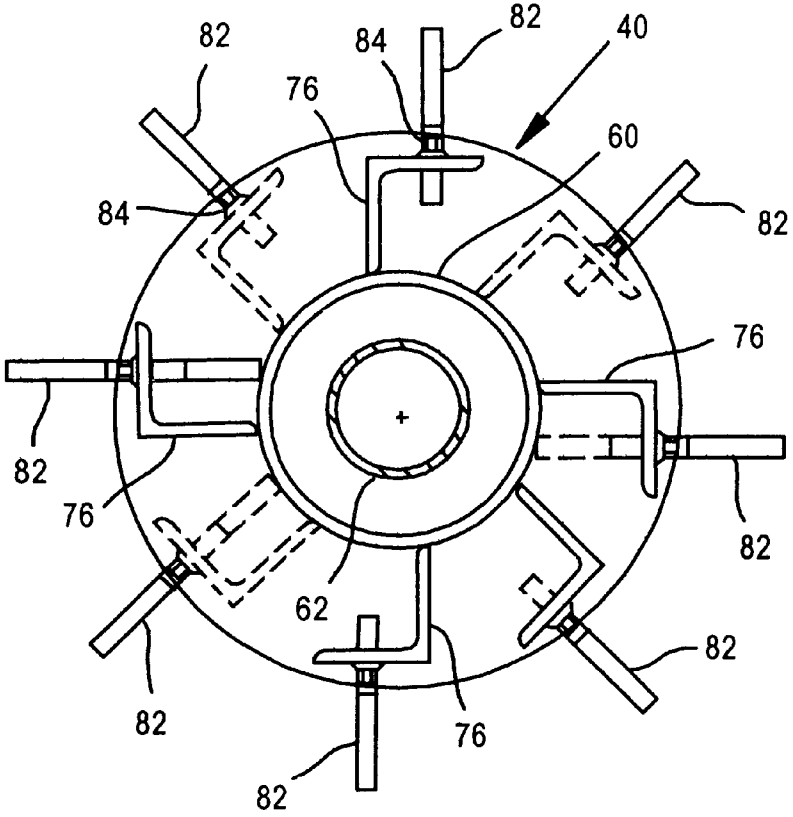
FIG. 7 is a sectional view taken substantially along line 7—7 of FIG. 6.

According to the present invention, a plurality of elongated tooth support members 76, 78, 80 are spaced around the tubular core, as shown by FIGS. 6 and 7. By way of typical and therefore non-limitive example, there are four members 76, four members 78, and four members 80. As shown by FIGS. 7 and 8, the two support members for each section are angularly spaced in position from the two support members of the adjacent section. In FIG. 7, the two support members 76 are shown at north, east, south and west positions. In FIG. 8, the two support members are shown in northeast, southeast, southwest and northwest positions. The two support members 80 are in axial alignment with the two support members 76. In other words, they are also in north, east, south and west positions and the 76, 78 are in the positions shown by FIGS. 7 and 8.

In preferred form, each tooth support member 76, 78, 80 is a length of angle iron. The angle iron members 76, 78, 80 are positioned such that they present an inner leg that preferably contacts the core tube 60 and an outer leg. The outer leg is substantially perpendicular to the inner leg and extends chordwise of the disks 68, 70, 72, 74. The inner leg is perpendicular to the outer leg but does not extend radially. The opposite ends of the two support members 76, 78, 80 are welded or otherwise firmly connected to the disks 68, 70, 72, 74.

Each tooth support member 76, 78, 80 supports a plurality of teeth or "spikes" 82 that are detachably connected to the outer leg of the tooth support member 76, 78, 80. The teeth or spikes 82 may be in the form of rods provided with a threaded connection 84 where they are connected to the tooth support members 76, 78, 80. As will be apparent, the angular staggering of the tooth support members 76, 78, 80 results in an angular staggering of the teeth 82 in the center section relative to the teeth 82 in the two end sections.

Figure 10:
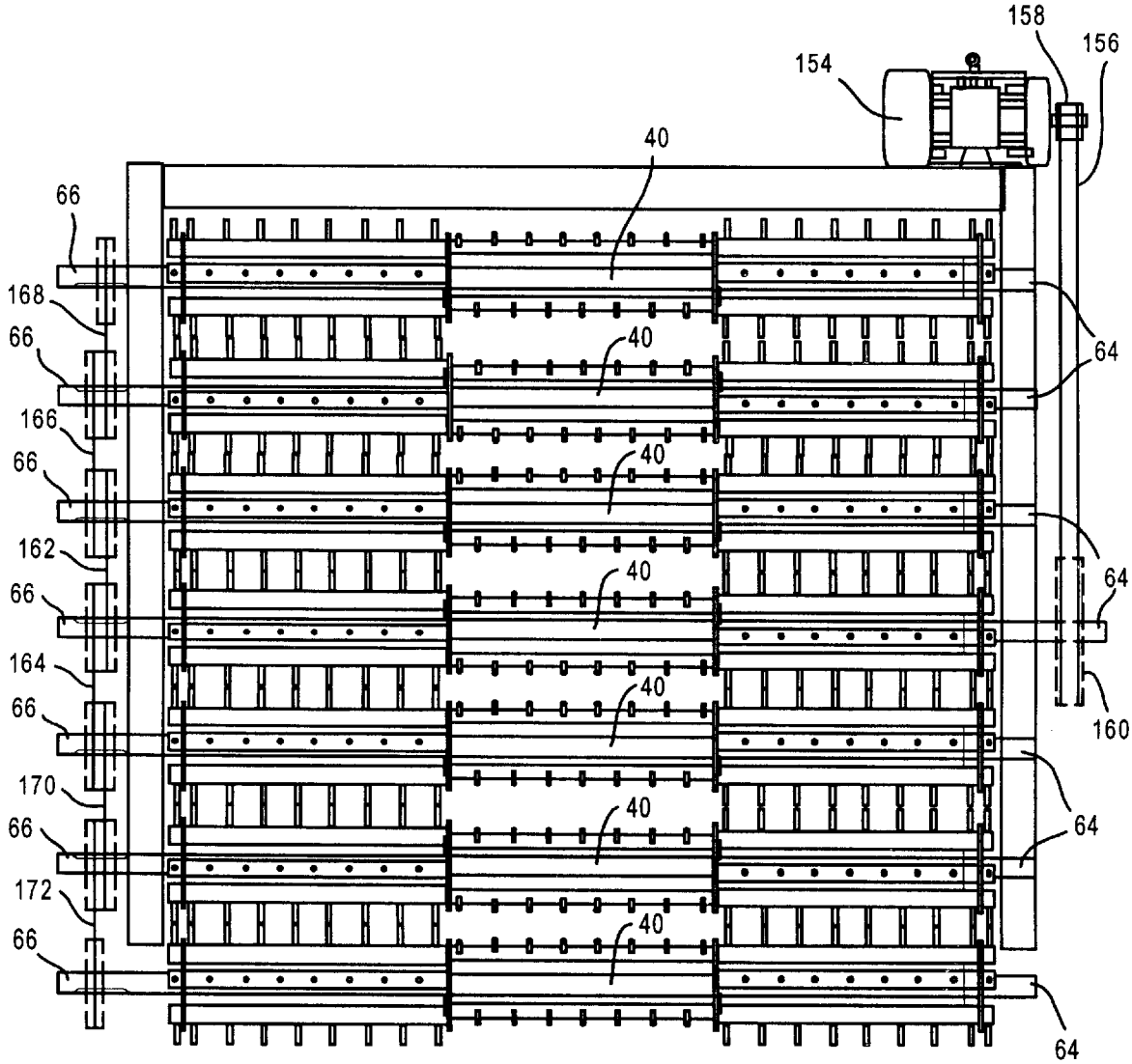
FIG. 10 is a sectional view taken substantially along line 10—10 of FIG. 9, such view including a drive train diagram showing how the disperser rolls are connected to the drive motor.

Referring to FIGS. 9 and 10, the disperser roll shafts 64, 66 are mounted onto frame portions of the tunnel structure 20, 22 by bearing assemblies that are shown in FIG. 9. Preferably, the tunnel structure includes diagonal frame members, one of which is designated 150 in FIG. 9. It also includes bottom rails, one of which is designated 152 in FIG. 9. In the illustrated embodiment, the bearing blocks for the upper five disperser rolls 40 are bolted to the frame member 150. The bearing block for the lowest disperser roll 40 is bolted to the bottom of frame member 152. The bearing block for the disperser roll 40 that is second from the bottom is bolted to the top of frame member 152. For each disperser 24, 26, 28, 30 a drive motor 154 is mounted on top of the disperser tunnel. As shown in FIG. 10, a drive belt assembly 156 may connect an output pulley 158 on motor 154 to a pulley 160 that is connected to end shaft 64 of the center disperser roll 40. In the illustrated embodiment, there are seven disperser rolls 40. Thus, there are three disperser rolls 40 above and three disperser rolls 40 below the center disperser roll 40. By way of typical and therefore non-limitive example, the drive belt assembly may comprise five vee belts. As also shown by FIG. 10, at the opposite ends of the disperser rolls 40, pulleys are connected to the end shaft 66 of the disperser rolls 40. Drive belts 162, 164, 166, 168, 170, 172 interconnect adjacent pulleys. The pulley on end shaft 66 for the center disperser is connected to both the pulley on the end shaft 66 above it and the pulley on the end shaft 66 below it. The connection pattern of the pulleys 162, 164, 166, 168, 170, 172 is shown in FIG. 10. Preferably, the belts are cogged belts or are timing belts. The belt and pulley drive system that is illustrated operates to rotate the disperser rolls 40 in the same direction and at substantially the same speed. The direction may be either clockwise or counterclockwise. The speed may be a variable speed that is determined by the output of motor 154. That is, a variable speed motor 154 may be used. Or, the motor may include a variable speed output transmission.

FIG. 11 is like FIG. 3 except that the outfeed conveyor 52 is elevated above the conveyors 32, 34 or, above the module support pads in installations that do not have conveyors under the modules. In the FIG. 11 embodiment, the mixing zone sidewalls 46, 48 of FIG. 3 are replaced by sidewalls 174, 176 which are shaped to help direct textile fiber clumps up on to the upper run 50 (not shown) of the conveyor 52, and to also shield against textile fiber clumps dropping between the lowermost disperser rolls 40 and the conveyor 52.

FIG. 12 shows the two disperser tunnels 20, 22 having separate outfeed conveyors 52 directed to convey towards each other. The conveyors 52 discharge the cotton boll clumps onto the upper run 178 of an endless belt conveyor 180. Herein, the term "blend" conveyor is used to designate a conveyor that extends from the outfeed conveyors to the first stage operation in the cleaning and ginning plant. In FIGS. 12 and 13, the conveyor 180 is a first stage mechanical conveyor that delivers the cotton boll clumps to an airstream conveyor 182 having an entry portion 184.

FIGS. 16 and 17 show the outfeed conveyors 52 feeding directly to the inlet 186 of an airstream conveyor 188. The inlet structure 188 has branches 190, 192 that are positioned over the discharge end portions 194 and 196 of the conveyors 180. Fans or pumps in the ducting 188 sucks up the cotton boll clumps and moves them on to the cleaning and ginning plant. The air conveyor 182 operates in the same way except the cotton boll clumps are dropped into its inlet structure 184.

Figure 18:
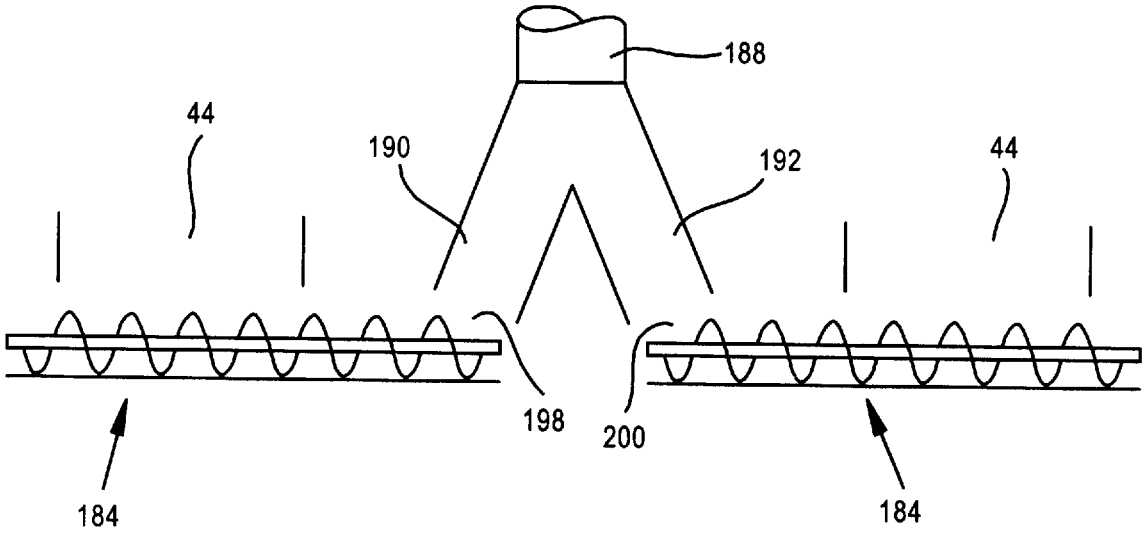
FIG. 18 is a view like FIG. 16, but showing the use of helical screw-type outfeed conveyors.
Figure 19:
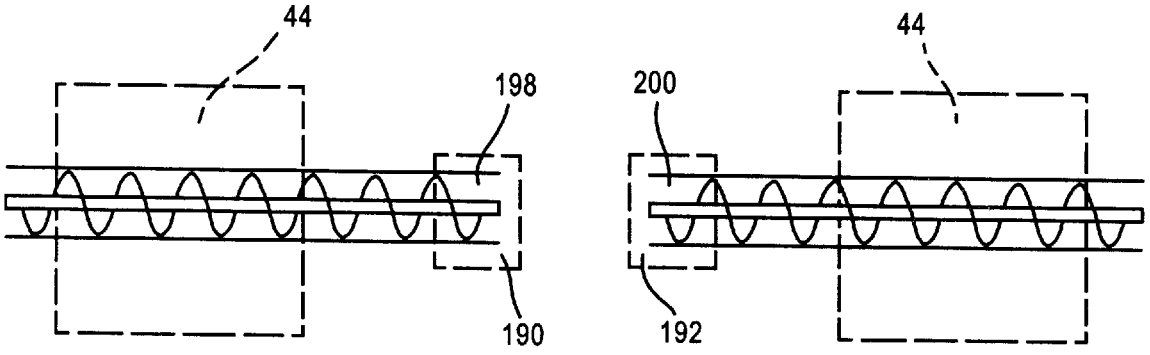
FIG. 19 is a view like FIG. 17, but showing the use of helical screw-type outfeed conveyors.

FIGS. 18 and 19 are like FIGS. 16 and 17 except that the endless belt-type outfeed conveyors 180 are replaced by the helical screw-type outfeed conveyors 184. In this installation, the inlet branches 190, 192 are positioned over the discharge end portions 198, 200 of the conveyors 184. As in the installation described above in connection with FIGS. 16 and 17, the cotton boll clumps are sucked into the ducting 190, 192, 188 and are delivered onto the cleaning and ginning plant.

Figure 20:
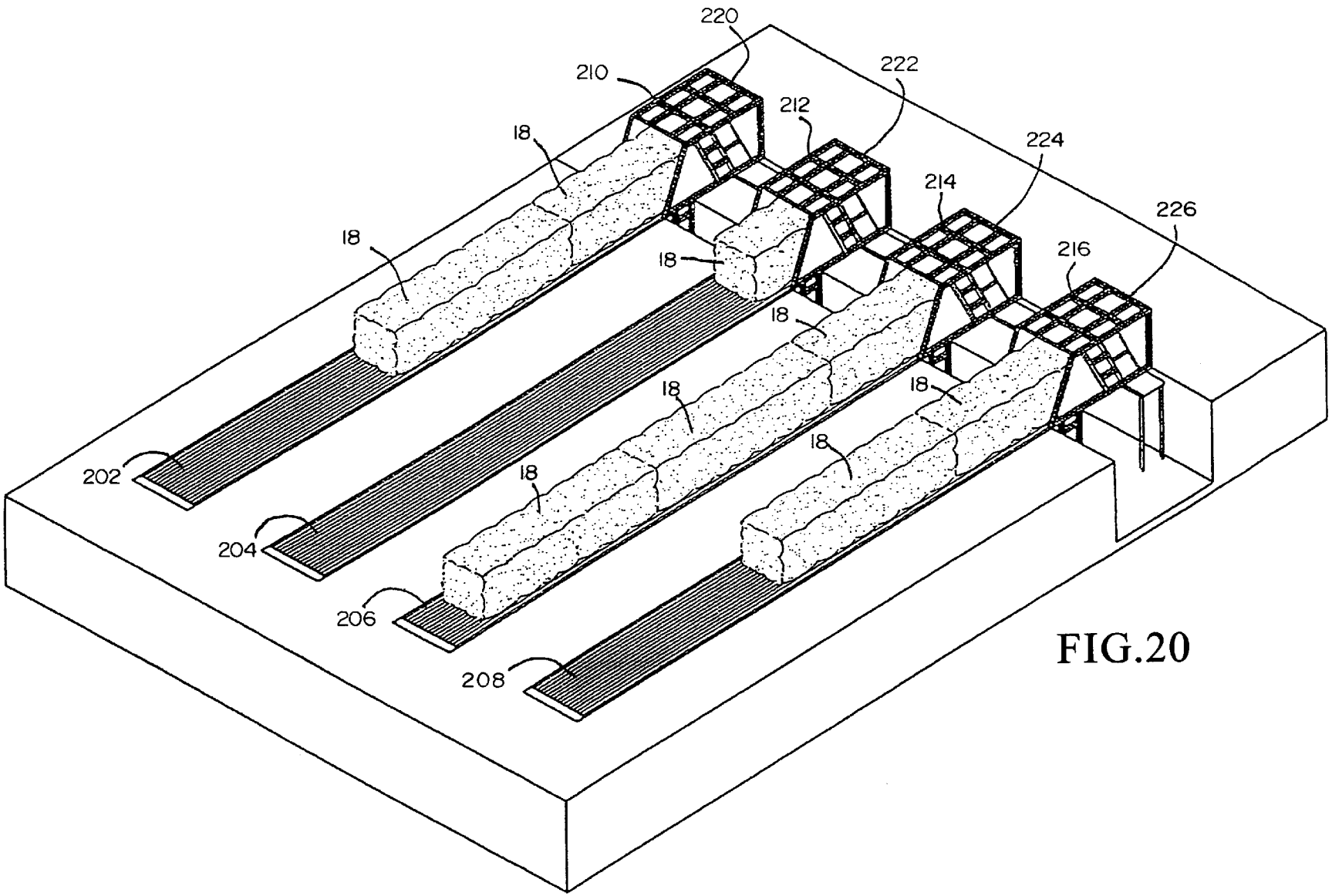
FIG. 20 is a view like FIG. 2, but showing four dispersers positioned side-by-side and further showing a single module feeding conveyor for each disperser.
Figure 21:
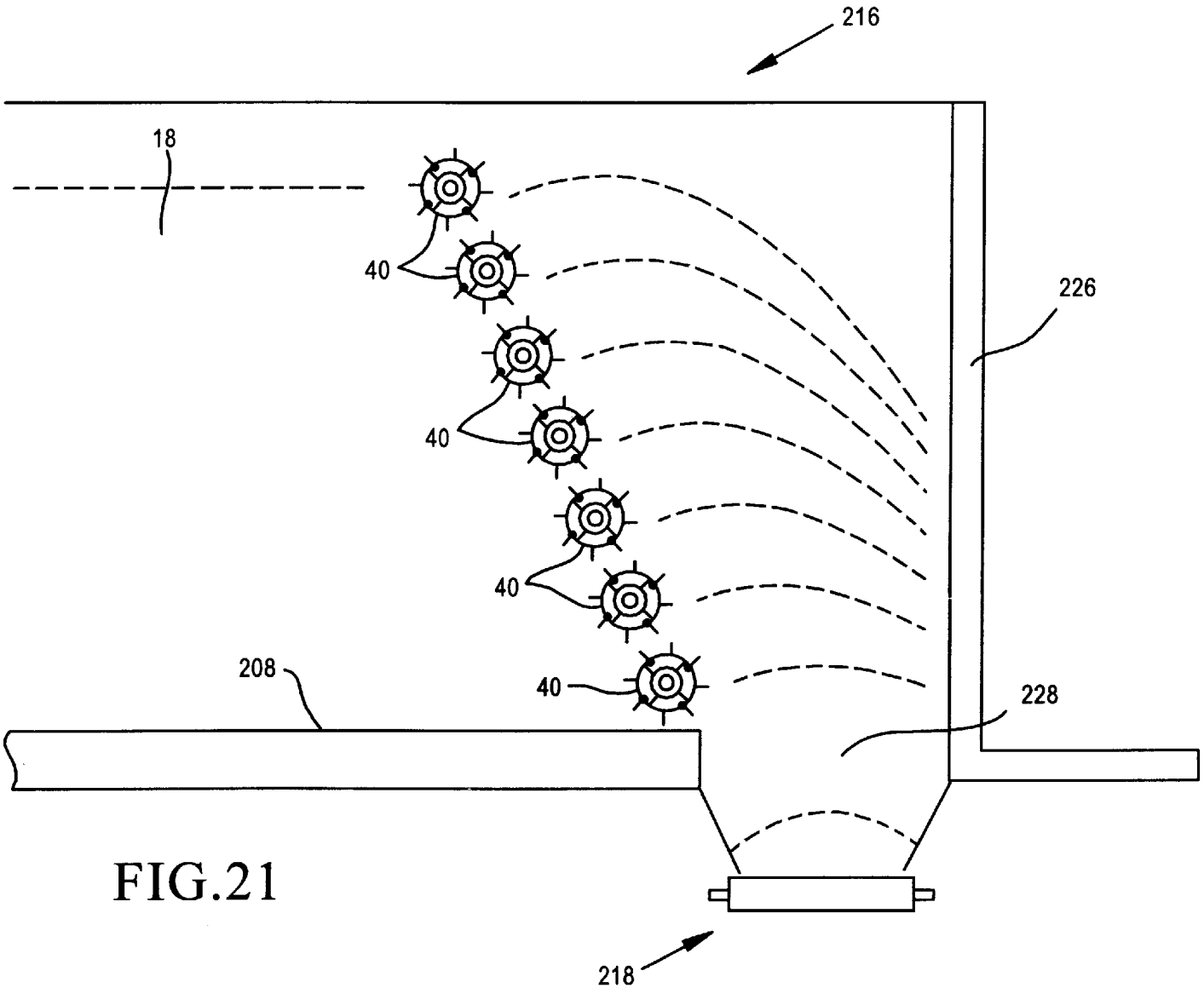
FIG. 21 is a view like FIG. 3, but with respect to the dispersers shown by FIG. 20.

FIG. 20 shows a plurality of infeed conveyors 202, 204, 206, 208 delivering cotton boll modules 18 to a plurality of disperser tunnels 210, 212, 214, 216. In FIG. 20, the infeed conveyors 202, 204, 206, 208 are shown in the form of reciprocating slat conveyors of the type that has been previously described. FIGS. 20 and 21 show an outfeed conveyor 218 positioned below the level of the tops of the conveyors 200, 204, 206, 208. Each disperser tunnel 210, 212, 214, 216 includes a disperser of the type that has been previously described (e.g. disperser 24). The disperser tunnels 210, 212, 214, 216 include closed end walls 220, 222, 224, 226. The cotton boll clumps are discharged by the disperser rolls 40 into a cotton boll collecting zone 28. A single outfeed conveyor 218 may extend through all of the collection zones 228, in series. Or, disperser tunnels 210, 212 may have a first outfeed conveyor and disperser tunnels 214, 216 may have a second outfeed conveyor, with the outfeed conveyors conveying towards each other and to a common discharge location that is between disperser tunnels 212, 214. Other arrangements may be used as well.

Figure 22:
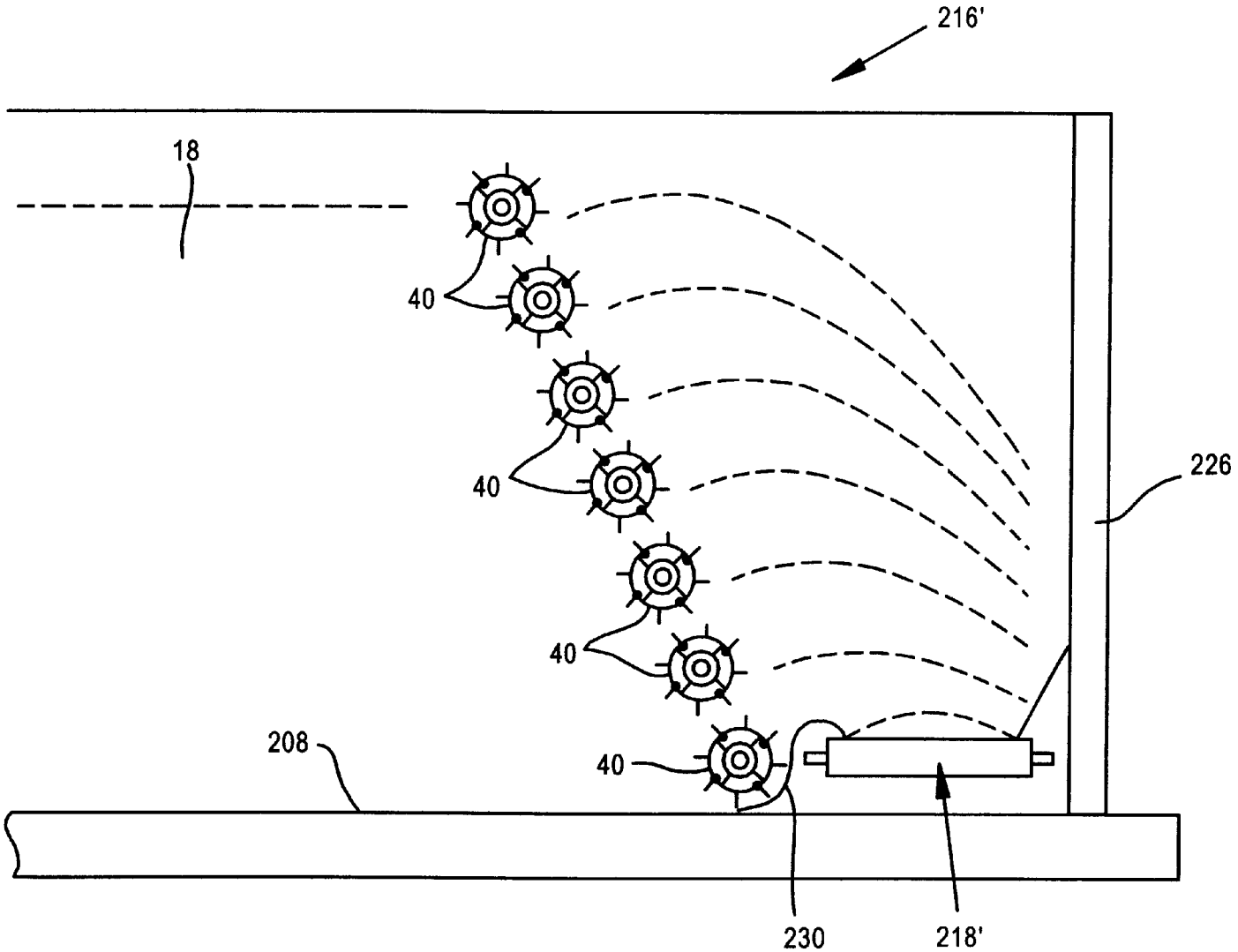
FIG. 22 is a view like FIG. 11, but with respect to the dispersers shown by FIG. 20.

FIG. 22 is like FIG. 21 except that the outfeed conveyor 218 is elevated to a position above the top surface of the conveyor 208, or the top surface of a pad on which the module sits in installations which do not have a conveyor below the modules 18. The embodiment of FIG. 22 includes a barrier 230 that helps guide cotton boll clumps up onto the upper run of the conveyor 218' and to also block against downward movement of cotton boll clumps between the lowest disperser roller 40 and the conveyor 218'.

Figure 23:
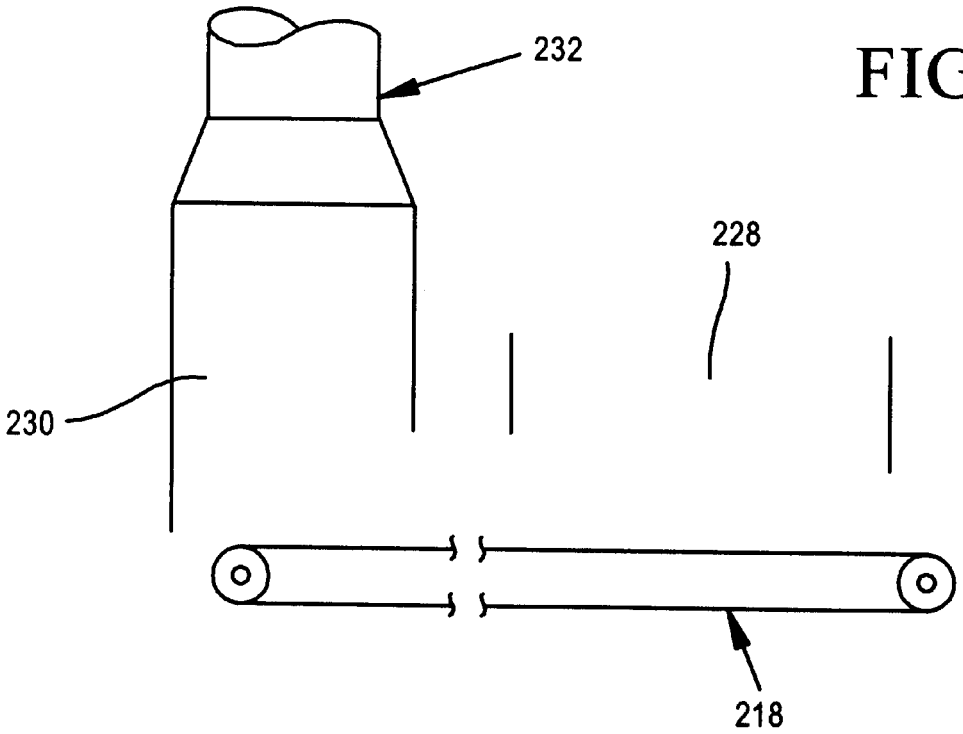
FIG. 23 is a view like FIG. 12, with respect to a disperser shown by FIG. 20.
Figure 24:
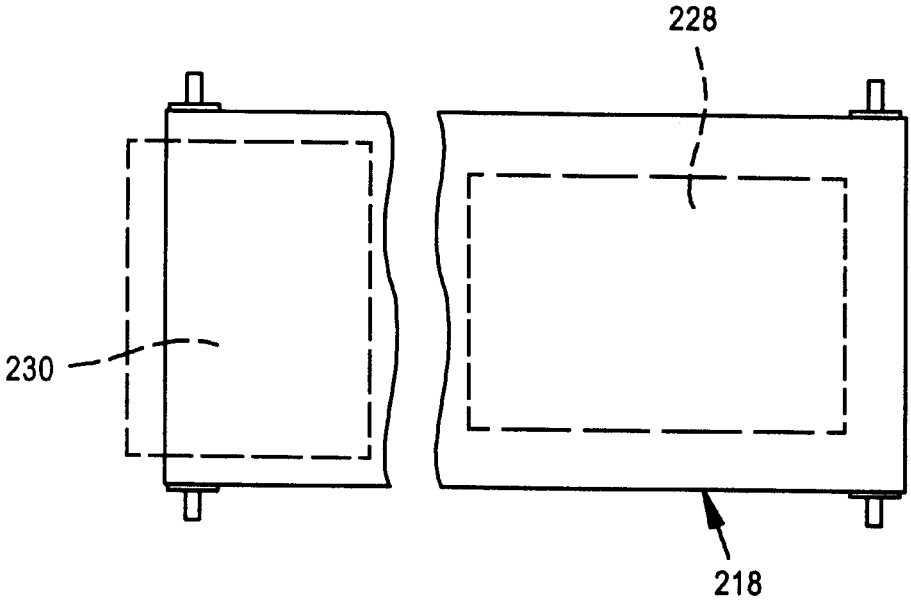
FIG. 24 is a view like FIG. 13, but with respect to a disperser of the type shown by FIG. 20.

FIGS. 23 and 24 show a single outfeed conveyor 218 that runs through all four cotton boll clump collection zones and delivers the cotton boll clumps into the inlet 230 of an airstream conveyor 232. In FIGS. 23 and 24, the outfeed conveyor 218 is broken away so as to show the entrance 228 for the outfeed conveyor 218 that is located in the first disperser tunnel 210, and show the airstream conveyor ducting 230, 230 positioned to receive cotton boll clumps from the conveyor 218.

Figure 25:
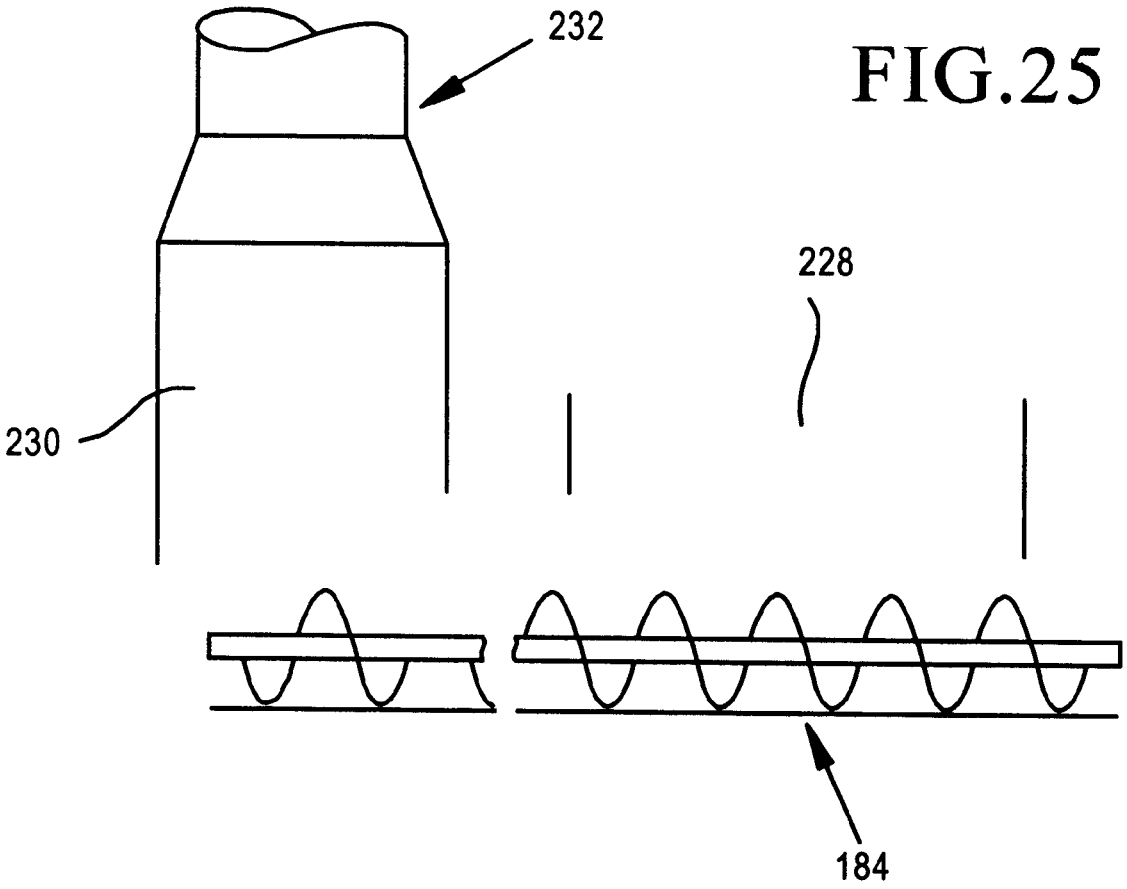
FIG. 25 is a view like FIG. 23, but showing a helical screw-type outfeed conveyor.
Figure 26:
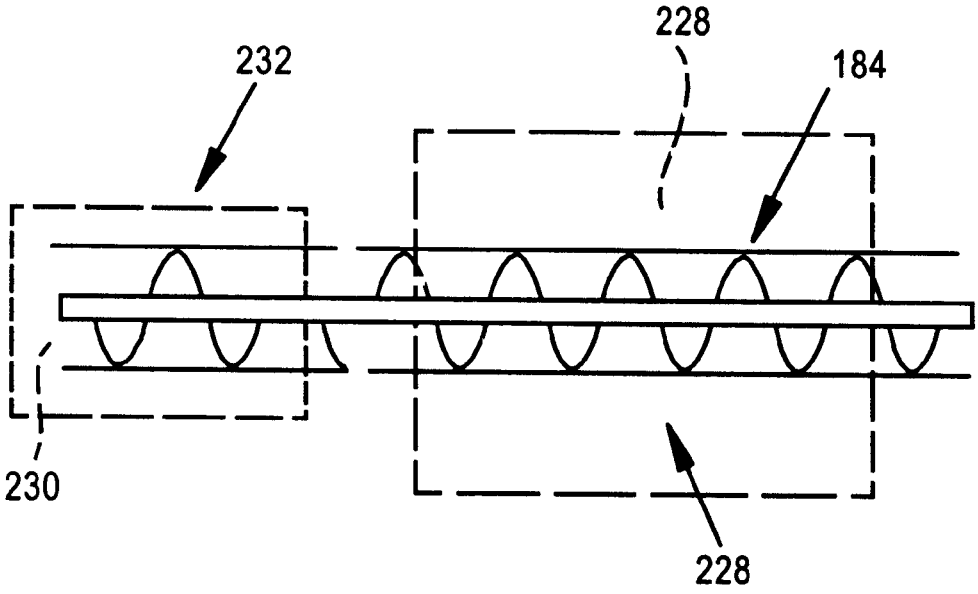
FIG. 26 is a view like FIG. 24, but showing a helical screw-type outfeed conveyor.

FIGS. 25 and 26 are like FIGS. 23 and 24 but show a helical screw conveyor 184 substituted for the endless belt conveyor 218. The conveyor 184 is cut away so as to show the beginning portion of it that is within the disperser tunnel 210 and to show the discharge portion of it that is downstream of the disperser tunnel 226, below the inlet structure 230 of the airstream conveyor 232.

Figure 27:
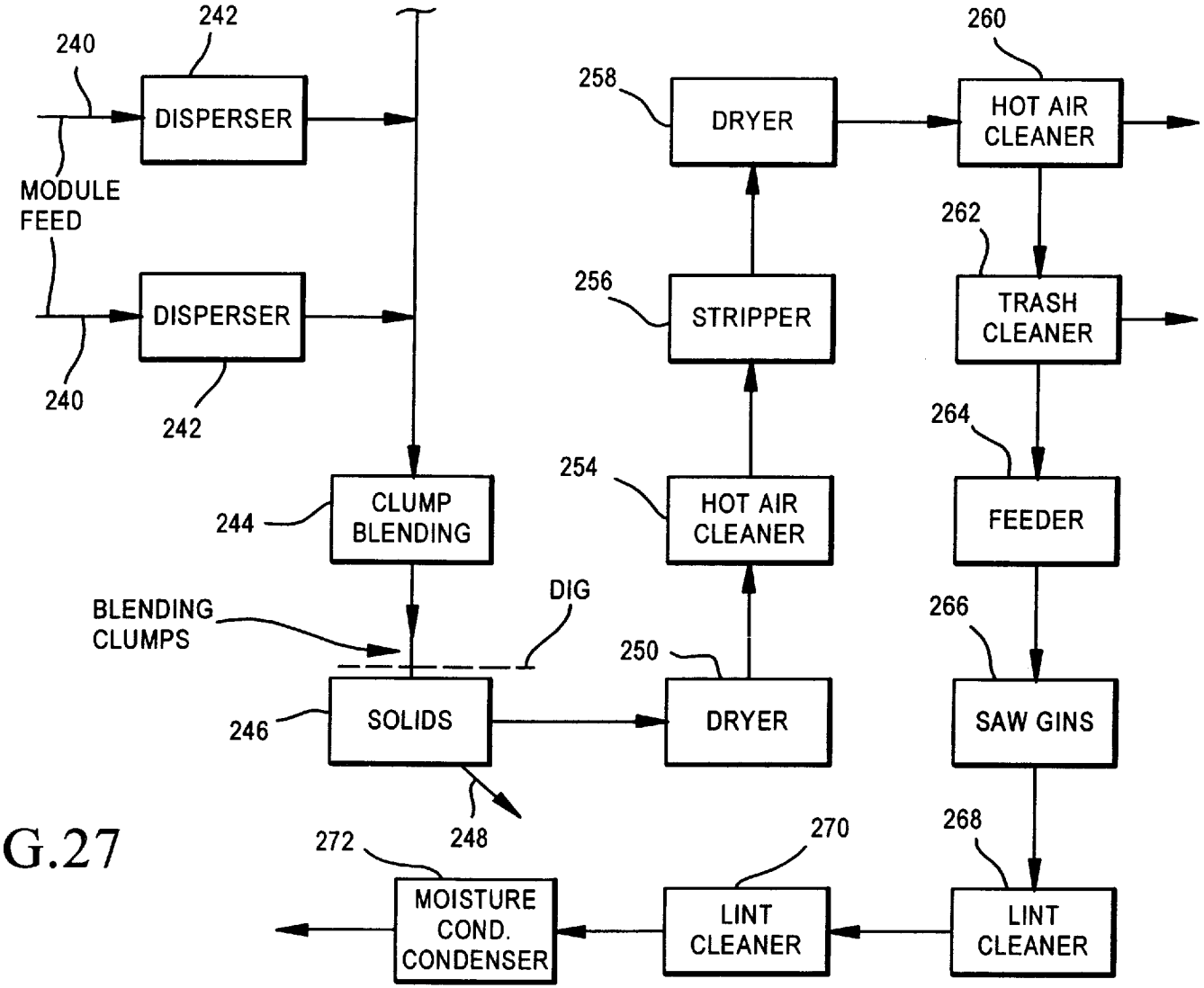
FIG. 27 is a flow diagram of a cotton particle handling system of the present invention.

FIG. 27 is a flow diagram of a ginning system that includes aspects of the invention. D/G identifies a dividing line between the disperser operation and the ginning operation. As will hereinafter be described, the ginning operation includes cleaning procedures in addition to the actual ginning.

The prior art practice has been to deliver cotton modules to a disperser located at a disperser station that is at the gin mill. The disperser or dispersers are used to disperse the cotton boll modules into cotton boll clumps. These clumps are then delivered into the ginning system, starting at boundary line G/G. Most commonly, the modules are dispersed one at a time. The dispersers are moved relative to stationary modules. Or, the modules are feed into the dispersers by use of various types of conveyor equipment. As previously described, U.S. Pat. No. 5,222,675; U.S. Pat. No. 5,469,603 and U.S. Pat. No. 5,934,445 each discloses using a reciprocating slat conveyor for feeding the modules into the dispersers.

As described above, in the practice of the present invention, the cotton boll clumps are mixed together upstream of the boundary line D/G so that it is blended cotton boll clumps that are delivered into the cleaning and ginning system. Referring to FIG. 27, two dispersers 242 are illustrated. However, it is to be understood that more than two dispersers can be used. Preferably, but not necessarily, the dispersers are used in confronting pairs so that the cotton boll clumps will be admixed as they leave the dispersers and fly into the mixing zone between the dispersers. In the confronting-disperser embodiments, the first mixing or blending of the cotton boll clumps (or other textile fiber clumps) occurs as a part of the dispersing operation. The clumps are then fed into an airstream conveyor. When a plurality of dispersers are used in parallel, the initial mixing or blending of the dispersed fibers occurs in the airstream conveyor section that leaves the dispersers 242, or mechanical conveyor sections downstream of the dispersers 242. According to an important aspect of the invention, measured quantities of different qualities of cotton boll clumps or other textile fiber clumps are mixed or blended to produce a blend of a quality that is somewhere between the lowest quality fibers selected and the highest quality fibers selected. Careful calculations are made so that the fiber clump mix delivered into the cleaning and ginning operation will produce blended lint of a desired quantity and quality. As previously mentioned, the feed rate of the various infeed conveyors can be regulated so as to vary the quantity of each quality of fiber that is added to the blend or mix. For example, if only two qualities of textile fiber clumps are mixed, it might be desirable to mix them fifty-fifty (50/50). In such case, the infeed conveyors will be operated to deliver the cotton modules 18 into the dispersers at the same rate of speed. Or, it might be desirable to mix together two quantities of fiber clumps from one module with one quantity of fiber clumps from a second module. This can be easily done by operating the infeed conveyors for the modules so that the infeed conveyor for the first quality modules will disperse the fiber clumps at twice the rate of the fiber clumps that are being dispersed from the other module. Fiber clumps from three qualities of fiber clump modules can be blended. And, fiber clumps from four or more qualities of fiber clump modules can be blended. The quantity and quality of the resulting blend or mixture can be regulated by regulating the feed rate of the infeed conveyors and hence the dispersion rate of the fiber clumps from the various modules.

As discussed above, the fiber clumps are ultimately picked up by an airstream conveyor and delivered by such conveyor into the cleaning and ginning plant, i.e. beyond boundary D/G. The equipment shown in FIG. 27 downstream of the boundary line D/G is equipment that already exists in the prior art. This portion of the flow diagram represents the more sophisticated flow diagram that is illustrated in a brochure produced by the Lummus Corporation, and entitled "The Gentle Ginning System." A copy of this brochure has been supplied to the United States Patent and Trademark Office for inclusion in the prosecution history of this patent.

In FIG. 27, a rock and boll separator 246 receives the blend of cotton boll clumps from the dispersers and removes at least some of the rocks out through path 248 and delivers the remaining portion of the mixture through path 250 to a tower dryer 252. The fiber blend then moves on to a hot air cleaner 254 and from the hot air cleaner 254 onto a stripper 256 in which sticks and leaves are removed. The effluent of stripper 256 moves on to another dryer 258 where it is heated and moisture is removed. The effluent from dryer 258 moves on to another hot air cleaner 260. The effluent of the hot air cleaner 260 moves on to a trash cleaner 262. The effluent of the trash cleaner 262 moves to a feed 264 which moves the fiber blend into saw gins 266. The effluent of the saw gins 266 moves on to a series of lint cleaners 268, 270. The effluent of lint cleaner 270 moves on to a moisture conditioning condenser 272.

After passing through the moisture conditioner condenser 272, the fiber blend may be balled and the bales may then be moved into storage or on to a customer. Or, the fiber blend may be collected in a truck/trailer box, for example, and delivered to a customer in an unballed condition.

A part of the present invention is that the fiber clumps that are moved past boundary D/G into the cleaning and ginning plant is already blended so that additional blending of the fiber lint does not have to be done by the customer who receives the lint.

The aforementioned application Ser. No. 09/654,144 is hereby expressly incorporated herein by this specific reference. Accordingly, aspects of the present invention can be used for blending particulate material.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. Apparatus for dispersing textile fiber clumps from a plurality of textile fiber modules and then mixing the clumps to form a blend, comprising:

a first pair of confronting dispersers, each having an input side and an output side, said output sides facing each other on opposite sides of a first mixing zone;

a second pair of confronting dispersers, each having an input side and an output side, said output sides facing each other on opposite sides of a second mixing zone;

an infeed conveyor for each disperser, each positioned to feed textile fiber modules into the input side of its disperser;

a separate outfeed conveyor for each pair of dispersers positioned in the mixing zone of the disperser;

a blend conveyor positioned to receive fiber clumps from the outfeed conveyors, wherein the infeed conveyors move textile fiber modules to the dispersers, each disperser removes textile fiber clumps from its module and discharges them airborne into its mixing zone into admixture with textile fiber clumps entering airborne in the mixing chamber from the disperser on the other side of said mixing zone, and wherein the mixed blends of textile fiber clumps fall onto the outfeed conveyors and the outfeed conveyors carry the blends of textile fiber clumps away from the dispersers to the blend conveyor.

2. The apparatus of claim 1, wherein the infeed conveyors are reciprocating slat conveyors.

3. The apparatus of claim 1, wherein the outfeed conveyors are mechanical conveyors.

4. The apparatus of claim 3, wherein the outfeed conveyors are endless belt conveyors.

5. The apparatus of claim 3, wherein the outfeed conveyors are helical screw conveyors.

6. The apparatus of claim 1, wherein the blend conveyor comprises a mechanical conveyor section followed by an airstream conveyor section, whereby the outfeed conveyors deliver blended textile fibers clumps from the two dispersers onto the mechanical conveyor section of the blend conveyor and the mechanical conveyor section of the blend conveyor delivers the fiber clumps into the airstream conveyor wherein they are fluidized and further blended as they are conveyed away from the dispersers.

7. Apparatus for dispersing textile fiber clumps from a plurality of textile fiber modules and then mixing the clumps to form a blend, comprising:

a first pair of confronting dispersers, each having an input side and an output side, said output sides facing each other on opposite sides of a first mixing zone;

a second pair of confronting dispersers, each having an input side and an output side, said output sides facing each other on opposite sides of a second mixing zone;

an infeed conveyor for each disperser, each positioned to feed textile fiber modules into the input side of its disperser;

a separate outfeed conveyor for each pair of dispersers positioned in the mixing zone of the disperser;

a blend conveyor positioned to receive fiber clumps from the outfeed conveyors, wherein the infeed conveyors are adapted to move textile fiber modules to the dispersers, each disperser removes textile fiber clumps from its module and discharges them into its mixing zone into admixture with textile fiber clumps from the disperser on the other side of said mixing zone, and the mixed blends of textile fiber clumps fall onto the outfeed conveyors and the outfeed conveyors carry the blends of textile fiber clumps away from the dispersers to the blend conveyor; and wherein the blend conveyor comprises an airstream conveyor having an inlet portion over the outfeed conveyors, wherein blends of textile fiber clumps are conveyed by the outfeed conveyors to the inlet portion of the airstream conveyor, are picked up by the airstream conveyor, and are fluidized and further mixed as they are conveyed forwardly by the airstream conveyor away from the dispersers.

8. Apparatus for dispersing textile fiber clumps from a plurality of textile fiber modules and then mixing the clumps to form a blend, comprising:

a plurality of dispersers, each having an input side and an output side, said output sides each facing a fiber clump receiving zone having a bottom, said disperser including a generally vertical stack of disperser rolls;

an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein the infeed conveyors move textile fiber modules to the dispersers, each disperser removes textile fiber clumps from its module and moves them through the disperser and discharges them airborne into the fiber clump receiving zone and onto the outfeed conveyor, and wherein the outfeed conveyor carries the blends of textile fiber clumps away from the dispersers to the blend conveyor.

9. The apparatus of claim 8, wherein the infeed conveyors are reciprocating slat conveyors.

10. The apparatus of claim 8, wherein the outfeed conveyor is a mechanical conveyor.

11. The apparatus of claim 10, wherein the outfeed conveyor is an endless belt conveyor.

12. The apparatus of claim 10, wherein the outfeed conveyor is a helical screw conveyor.

13. The apparatus of claim 8, wherein the dispersers and the infeed conveyors are parallel to each other and each disperser discharges onto an outfeed conveyor that extends perpendicular to the infeed conveyors.

14. The apparatus of claim 8, wherein the outfeed conveyors are below the level of the infeed conveyors.

15. The apparatus of claim 8, comprising two dispersers on opposite sides of the fiber clump receiving zone, said dispersers having output sides that face each other on opposite sides of the fiber clump receiving zone, whereby each disperser removes textile fiber clumps from its module and discharges them airborne into said fiber clump receiving zone into admixture with the textile fiber clumps entering airborne from the disperser on the other side of said zone, and wherein the mixed blends of textile fiber clumps fall onto the outfeed conveyor and the outfeed conveyor carries the blends of textile fiber clumps away from the disperser toward the blend conveyor.

16. The apparatus of claim 15, wherein the outfeed conveyor is below the level of the infeed conveyor.

17. Apparatus for dispersing textile fiber clumps from a plurality of textile fiber modules and then mixing the clumps to form a blend, comprising:

a plurality of dispersers, each having an input side and an output side, said output sides each facing a fiber clump receiving zone having a bottom, an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein the infeed conveyors move textile fiber modules to the dispersers, each disperser removes textile fiber clumps from its module and discharges them into the fiber clump receiving zone, onto the outfeed conveyor and the outfeed conveyor carries the blends of textile fiber clumps away from the dispersers to the blend conveyor; and wherein the blend conveyor comprises an airstream conveyor section having an inlet portion, whereby blends of textile fiber clumps are picked up by the airstream conveyor and are fluidized and further mixed as they are conveyed forwardly by the airstream conveyor, away from the dispersers.

18. Apparatus for dispersing textile fiber clumps from a plurality of textile fiber modules and then mixing the clumps to form a blend, comprising:

a plurality of dispersers, each having an input side and an output side, said output sides each facing a fiber clump receiving zone having a bottom, an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein the infeed conveyors move textile fiber modules to the dispersers, each disperser removes textile fiber clumps from its module and discharges them into the fiber clump receiving zone, onto the outfeed conveyor and the outfeed conveyor carries the blends of textile fiber clumps away from the dispersers to the blend conveyor; and wherein the blend conveyor comprises a mechanical conveyor section followed by the airstream conveyor section, wherein the outfeed conveyors deliver blended textile fibers from the two disperser onto the mechanical conveyor section of the blend conveyor and the mechanical conveyor section of the blend conveyor delivers the fiber clumps into the airstream conveyor, and wherein they are fluidized and further blended as they are conveyed away from the dispersers.

19. Apparatus for dispersing textile fiber clumps from a plurality of textile fiber modules and then mixing the clumps to form a blend, comprising:

a plurality of dispersers, each having an input side and an output side, said output sides each facing a fiber clump receiving zone having a bottom, an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein the infeed conveyors move textile fiber modules to the dispersers, each disperser removes textile fiber clumps from its module and discharges them into the fiber clump receiving zone, onto the outfeed conveyor and the outfeed conveyor carries the blends of textile fiber clumps away from the dispersers to the blend conveyor; and wherein the outfeed conveyors are above the level of the infeed conveyors.

20. Apparatus for dispersing textile fiber clumps from a plurality of textile fiber modules and then mixing the clumps to form a blend, comprising:

two dispersers, each having an input side and an output side, said output sides each facing each other on opposite sides of a fiber clump receiving zone having a bottom, an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein each disperser removes textile fiber clumps from its module and discharges them into said fiber clump receiving zone into admixture with the textile fiber clumps from the disperser on the other side of said zone, and the mixed blends of textile fiber clumps fall onto the outfeed conveyor and the outfeed conveyor carries the blends of textile fiber clumps away from the disperser toward the blend conveyor; and wherein the outfeed conveyor is above the level of the infeed conveyor.

21. Apparatus for dispersing textile fiber clumps from a plurality of textile fiber modules and then mixing the clumps to form a blend, comprising:

two dispersers, each having an input side and an output side, said output sides each facing each other on opposite sides of a fiber clump receiving zone having a bottom, an infeed conveyor for each disperser, each positioned to feed textile fiber modules into the input side of its disperser;

an outfeed conveyor in the fiber clump receiving zone and positioned for receiving fiber clumps;

a blend conveyor positioned to receive fiber clumps from the outfeed conveyor, wherein each disperser removes textile fiber clumps from its module and discharges them into said fiber clump receiving zone into admixture with the textile fiber clumps from the disperser on the other side of said zone, and the mixed blends of textile fiber clumps fall onto the outfeed conveyor and the outfeed conveyor carries the blends of textile fiber clumps away from the disperser toward the blend conveyor; and wherein the blend conveyor comprises an airstream conveyor section having an inlet portion, and wherein blends of textile fiber clumps are picked up by the airstream conveyor and are fluidized and further mixed as they are conveyed forwardly by the airstream conveyor, away from the dispersers.

22. A method of dispersing and blending textile fiber clumps from a plurality of textile fiber modules, comprising:

positioning first and second dispersers at a disperser station, each said disperser including disperser rollers having disperser fingers;

operating the first and second dispersers while feeding a first textile fiber module against the first disperser and feeding a second textile fiber module against the second disperser;

operating said first and second dispersers so that each disperser roller will rotate and its finger will disperse fiber clumps from a said module and deliver them through the disperser and airborne into a fiber clump receiving zone;

collecting the fiber clumps on a conveyor in the fiber clump receiving zone and operating the conveyor to convey the fiber clumps onto the inlet of a fluid conveyor section; and using said fluid conveyor section to convey, fluidize and blend the textile fiber clumps, while conveying them away from the dispersers.

23. The method of claim 22, comprising feeding the textile fiber modules against the dispersers by use of conveyors, and controlling the feed rate of the modules by controlling conveyor speed.

24. The method of claim 22, comprising positioning the first and second dispersers at the disperser station, in a spaced apart confronting relationship, so that the fiber clump receiving zone is between them; and operating the first and second dispersers while feeding a first textile fiber module against the first disperser and feeding a second textile fiber module against the second disperser, so that each will disperse fiber clumps from its module and deliver them airborne into the fiber clump receiving zone, in admixture with the airborne fiber clumps from the other disperser.

25. The method of claim 24, comprising positioning third and fourth dispersers at the disperser station in a spaced apart confronting relationship, so as to define a second fiber clump receiving zone between them;

operating the third and fourth dispersers while feeding a third textile fiber module against the third disperser and feeding a fourth textile fiber module against the fourth disperser;

operating said third and fourth dispersers so that each will disperse fiber clumps from its module and deliver them airborne into the second fiber clump receiving zone in admixture with the airborne fiber clumps from the other disperser of the pair; and collecting the mixture of fiber clumps from the two fiber clump receiving zones and carrying it away from the disperser station.

26. The method of claim 25, further comprising using conveyors for feeding the textile fiber modules against the dispersers, and controlling the feed rate of the module s by controlling conveyor speed.

27. The method of claim 26, comprising using reciprocating slat conveyors for feeding the textile fiber modules to the dispersers.

28. The method of claim 22, comprising positioning the first and second dispersers at the disperser station, in a spaced apart parallel relationship.

29. The method of claim 28, comprising using a single conveyor that passes through the fiber clump receiving zones of the first and second dispersers for delivering fiber clumps to the inlet of the fluid conveyor section.

30. The method of claim 28, comprising using separate conveyors for collecting the fiber clumps from the fiber clump receiving zones of the dispersers and carrying the fiber clumps onto the inlet of the fluid conveyor section.

* * * * *